US006011243A

United States Patent [19]

Arnold et al.

[11] Patent Number: 6,011,243

[45] Date of Patent: Jan. 4, 2000

[54] HOLDING CABINET AND METHOD AND APPARATUS FOR CONTROLLING A HOLDING CABINET

[76] Inventors: Anthony W. Arnold, 5400 Overton Rd., Nashville, Tenn. 37220; Steven B. Collins, 934 Damron Rd., Estill Springs, Tenn. 37330; Jack M. Johnson, 143 Lake Park Dr., Nashville, Tenn. 37211; Jeffrey S. Williams, 879 Stonebrook Blvd., Nolensville, Tenn. 37135; John M. Cox, 205 Key Ct., Brentwood, Tenn. 37027; John Guthrie, 120 Timber Ridge, Nashville, Tenn. 37217; Thomas A. McMillan, 713 Vosswood Dr., Nashville, Tenn. 37205

[21] Appl. No.: 08/881,158

[22] Filed: Jun. 24, 1997

Related U.S. Application Data

[60] Provisional application No. 60/020,691, Jun. 27, 1996.

[51] Int. Cl.[7] ..... H05B 1/02

[52] U.S. Cl. ..... 219/506; 219/486; 219/214; 219/494; 99/484; 99/468; 221/150 A; 221/150 R

[58] Field of Search ..... 219/214, 497, 219/494, 483–486, 506; 221/150 A, 150 R, 224, 225, 211, 298, 122, 150 HC; 99/468, 335, 483, 484, 357

[56] References Cited

U.S. PATENT DOCUMENTS 5,093,556 3/1992 Oelfke ..... 219/386
5,188,020 2/1993 Buchnag ..... 99/468
5,579,952 12/1996 Fiedler et al. ..... 221/150 A
5,772,072 6/1998 Prescott ..... 221/121

OTHER PUBLICATIONS

Chromalox: User's Manual 3390 Multiloop Controller, pp. 1–107, Jan. 1992.

*Primary Examiner*—Mark Paschall

[57] ABSTRACT

A cabinet and control system for maintaining a food product within a predetermined temperature range for a holding period of time not exceeding a predetermined maximum time. The cabinet comprises a housing having a front panel and a passageway opening at the front panel. The passageway is capable of receiving at least two containers of the food product. A temperature element positioned in said passageway maintains the passageway within the predetermined temperature range. A processing circuit tracks the amount of time each container of food product remains within the passageway. The processing circuit provides a signal output indicating which container has been within said passageway the longest and an alarm signal when either container remains within said passageway beyond said maximum time. A display positioned on said housing proximate to said passageway receives the said signal output and indicates which container has been within the passageway the longest. The display also receives the alarm signal and indicates which one of the containers has been within the passageway for a period of time exceeding the predetermined maximum time.

57 Claims, 26 Drawing Sheets

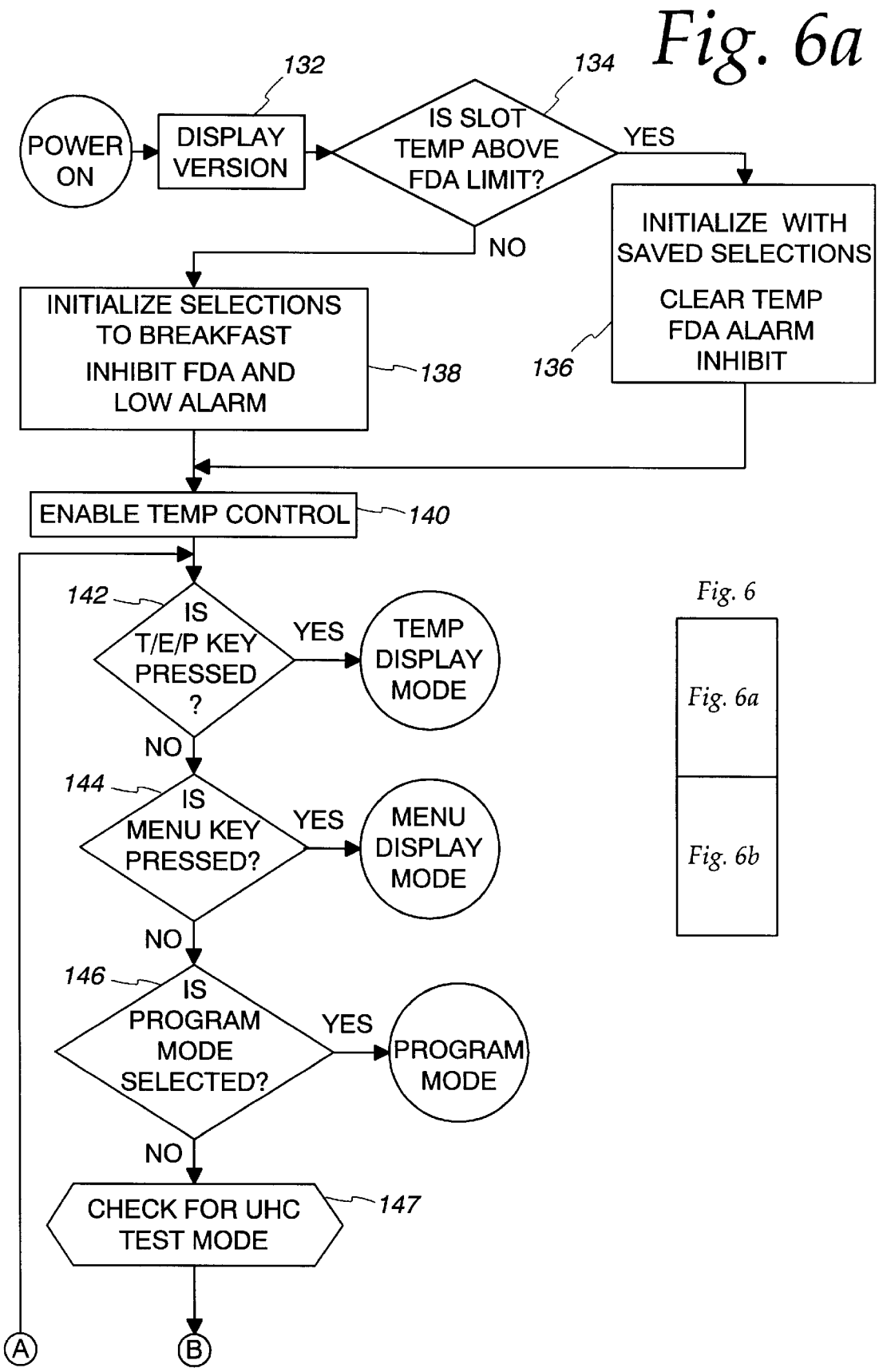
Fig. 6a
POWER ON
DISPLAY VERSION
132
IS SLOT TEMP ABOVE FDA LIMIT?
134
YES
NO
INITIALIZE WITH SAVED SELECTIONS
CLEAR TEMP FDA ALARM INHIBIT
136
INITIALIZE SELECTIONS TO BREAKFAST
INHIBIT FDA AND LOW ALARM
138
ENABLE TEMP CONTROL
140
142
IS T/E/P KEY PRESSED ?
YES
TEMP DISPLAY MODE
NO
144
IS MENU KEY PRESSED?
YES
MENU DISPLAY MODE
NO
146
IS PROGRAM MODE SELECTED?
YES
PROGRAM MODE
NO
CHECK FOR UHC TEST MODE
147
A
B Fig. 6
Fig. 6a
Fig. 6b

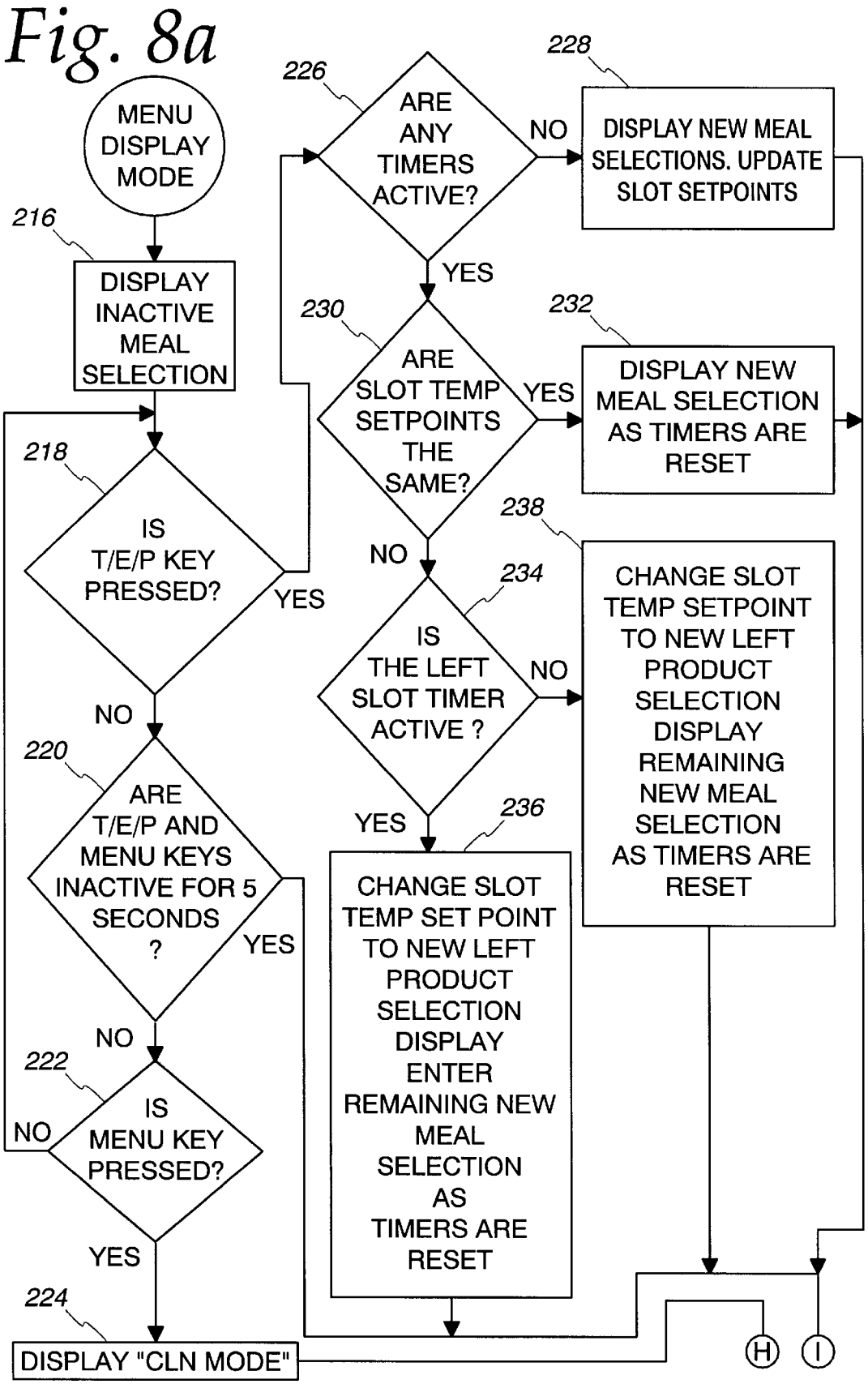
Fig. 8a
MENU DISPLAY MODE
216
DISPLAY INACTIVE MEAL SELECTION
218
IS T/E/P KEY PRESSED?
YES
NO
220
ARE T/E/P AND MENU KEYS INACTIVE FOR 5 SECONDS ?
YES
NO
222
IS MENU KEY PRESSED?
NO
YES
224
DISPLAY "CLN MODE"
226
ARE ANY TIMERS ACTIVE?
NO
YES
228
DISPLAY NEW MEAL SELECTIONS. UPDATE SLOT SETPOINTS
230
ARE SLOT TEMP SETPOINTS THE SAME?
YES
NO
232
DISPLAY NEW MEAL SELECTION AS TIMERS ARE RESET
234
IS THE LEFT SLOT TIMER ACTIVE ?
NO
YES
236
CHANGE SLOT TEMP SET POINT TO NEW LEFT PRODUCT SELECTION DISPLAY ENTER REMAINING NEW MEAL SELECTION AS TIMERS ARE RESET
238
CHANGE SLOT TEMP SETPOINT TO NEW LEFT PRODUCT SELECTION DISPLAY REMAINING NEW MEAL SELECTION AS TIMERS ARE RESET
H
I

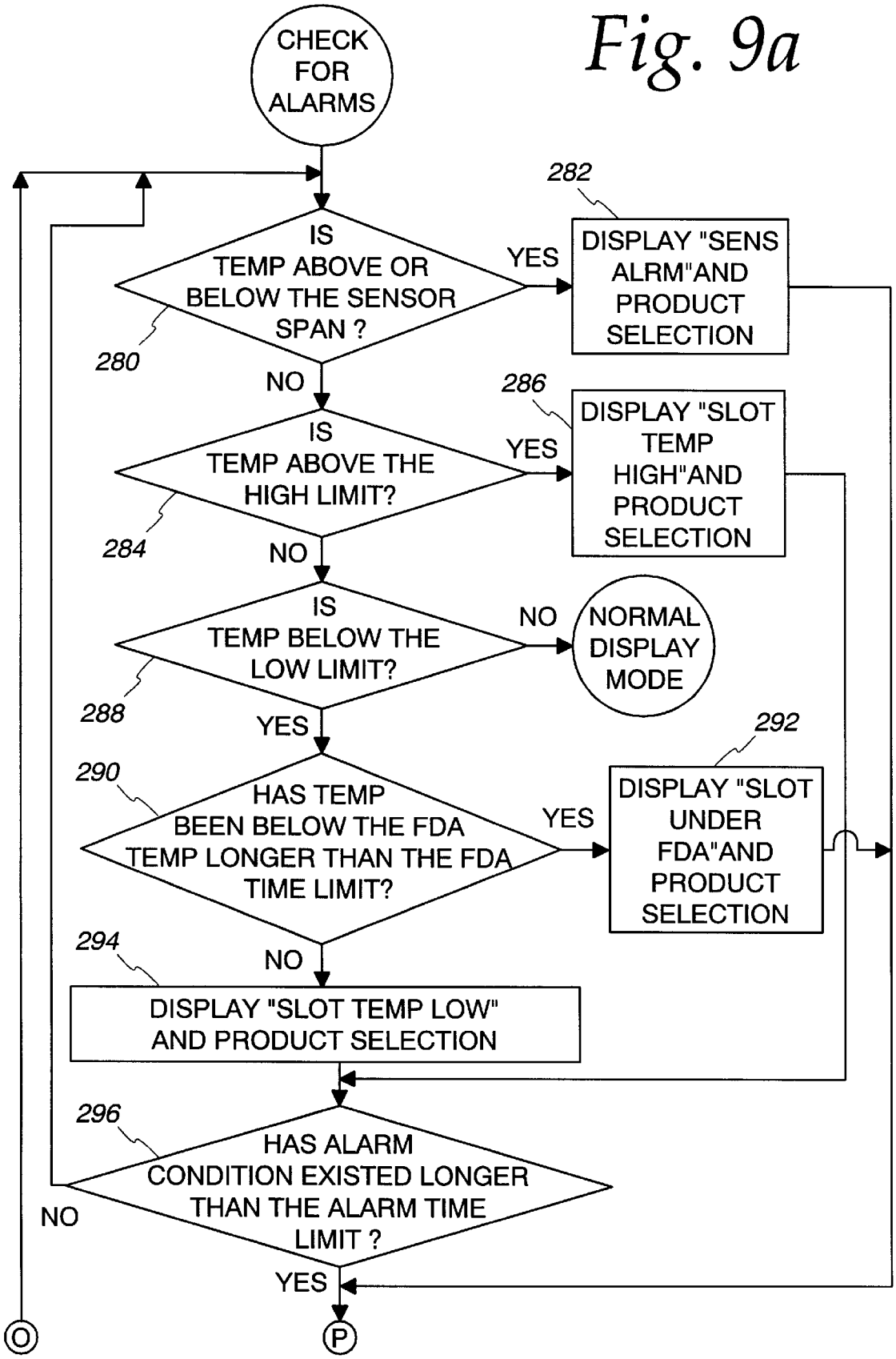
Fig. 9a
CHECK FOR ALARMS
IS TEMP ABOVE OR BELOW THE SENSOR SPAN ?
280
YES
282
DISPLAY "SENS ALRM"AND PRODUCT SELECTION
NO
IS TEMP ABOVE THE HIGH LIMIT?
284
YES
286
DISPLAY "SLOT TEMP HIGH"AND PRODUCT SELECTION
NO
IS TEMP BELOW THE LOW LIMIT?
288
NO
NORMAL DISPLAY MODE
YES
HAS TEMP BEEN BELOW THE FDA TEMP LONGER THAN THE FDA TIME LIMIT?
290
YES
292
DISPLAY "SLOT UNDER FDA"AND PRODUCT SELECTION
NO
294
DISPLAY "SLOT TEMP LOW" AND PRODUCT SELECTION
HAS ALARM CONDITION EXISTED LONGER THAN THE ALARM TIME LIMIT ?
296
NO
YES
O
P

HOLDING CABINET AND METHOD AND APPARATUS FOR CONTROLLING A HOLDING CABINET

CROSS-REFERENCE TO RELATED APPLICATION

This applications claims the benefit of U.S. Provisional Application Ser. No. 60/020,691, filed Jun. 27, 1996.

FIELD OF THE INVENTION

This invention relates to food holding or warming cabinets and a control system for maintaining the climate within the cabinet and for receiving and for disseminating information from and to the operator. In addition, the present invention relates to a method for improving the control of the climate within the food warming cabinet, and for improving an interface between the control system and an operator to facilitate the input of data and the display of information.

BACKGROUND OF THE INVENTION

In restaurants and food service establishments there is a need to maintain cooked food at temperatures where the quality of the food will not degrade over time and which allows the food to be quickly served. This is especially true in so-called "fast food" restaurants where a relatively large volume of different food products must be maintained in a sellable state allowing quick delivery to the customer. If the food is not cooked until the customer orders, the service will be too slow to satisfy the average customer. If the food is precooked and then refrigerated, the heating time required subsequent to the customer's order is reduced, however, the taste, consistency, and appearance of the food may be detrimentally altered during reheating. It has been found that for a balance of fast service along with the acceptable taste, consistency, and appearance required by fast food restaurants, the food should be cooked and then stored at a temperature which is high enough to allow the precooked food to be served upon ordering.

Previous food warming units known in the art have had problems keeping food at the appropriate temperature. This was especially true when the food warming cabinet was required to maintain more than one type of food or food product category at a single time. Different types of food or categories of food products need to be maintained at different temperatures in order to maximize the amount of time they can be stored between cooking and being served.

In addition, each category of food products stored in a warming cabinet has a set holding life before it must be immediately served or otherwise destroyed. Previous food warming units use countdown timers mounted in the comer of the cabinet. When an food product is placed in the cabinet, the operator sets a countdown timer. Problems develop when multiple items of the same food product category are placed in the warming cabinet at different times. Previous food warming units known in the art do not adequately inform the operator which item has the least amount of holding time remaining before destruction is necessary. The timer provides no correlation between the time remaining and the individual food items. This problem compounds when several operators place and remove food items from the same cabinet. Because the timer provides no information identifying the time each food item has been in the cabinet, the operators must rely on their memory or communications between themselves. The operators often forget which food item has been in the cabinet the longest and overlook the food items that must be used first resulting in spoiled or poor quality food.

Further, in food holding cabinets known in the art that have electronic control systems, the electronic circuitry associated with the controller has been necessarily located proximate to the heat source in the food warmer. Because the electronics are constantly exposed to heat, the control circuitry has a shortened useful life span. This results in unnecessary failures of the holding cabinet controls and greater food spoilage.

Thus, a need has arisen for a new holding cabinet and a control system which will maintain multiple categories of food products at different temperatures and for different time periods, will provide a user friendly method of selecting the appropriate maximum holding time and temperature for a given category of food product, will communicate to the operator which food item from each category of food product in the cabinet must be served first, will communicate to the operator for each food item the holding time remaining before that food item must be served or destroyed, will notify the operator when the temperature in the cabinet falls below a holding set point, and will provide a distributed control system to locate the majority of the control circuitry in the cooler portions of the holding cabinet.

BRIEF SUMMARY OF THE INVENTION

In accordance with one aspect of the present invention, a holding cabinet and a control system are capable of maintaining at least two food items or containers of food product from the same food product category within a predetermined temperature range for a period of time not exceeding a predetermined maximum time. The cabinet comprises a housing having a front panel and a passageway opening at the front panel. The passageway is capable of receiving at least two containers of the food product from the same food product category. A temperature element positioned in the passageway maintains the passageway and accordingly the food product in the containers at the predetermined temperature. A processing circuit tracks the amount of time each container of the food product remains within the passageway. The processing circuit signals a display to indicate which container has been within the passageway the longest. The processing circuit also signals the display to indicate an alarm when either container remains within the passageway beyond the predetermined maximum time.

In accordance with another aspect of the present invention, a holding cabinet and a control system are capable of maintaining at least two containers holding a food product from a first food product category and at least two additional containers holding a food product from a second food product category within a first and second predetermined temperature range for a holding period of time not exceeding a predetermined first and second maximum time respectively. The holding cabinet comprises a housing having a front panel and a first and second passageway opening at the front panel. The first passageway is capable of receiving at least two containers holding a first food category and the second passageway is capable of receiving at least two containers holding a second food category. A temperature element positioned in each of the passageways maintains the first passageway within the first predetermined temperature range and the second passageway within the second predetermined temperature range. A processing circuit tracks the amount of time each container of food remains within its respective passageway. The processing circuit signals a first display to indicate which container has been in the first passageway the longest and signals a second display to indicate which container has been in the second passageway the longest. The processing circuit also signals the first display to indicate an alarm when any container in the first passageway remains beyond the first predetermined maximum time. The processing circuit also signals the second display to indicate an alarm when any container in the second passageway remains beyond the second predetermined maximum time.

In accordance with a further aspect of the present invention, the control system is capable of maintaining multiple categories of food products at different temperatures and for different time periods, providing a user friendly method of selecting the appropriate maximum holding time and temperature for a given category of food product, communicating to the operator which food item from each category of food product in the cabinet must be served first, communicating to the operator for each food item the holding time remaining before that food item must be served or destroyed, notifying the operator when the temperature in the cabinet falls below a holding set point, and providing a distributed control system to locate the majority of the control circuitry in the cooler portions of the holding cabinet.

BRIEF DESCRIPTION OF THE FIGURES

The foregoing and other advantages of the invention will become apparent upon reading the following detailed description and upon reference to the drawings which:

FIGS. 6*a* and 6*b* are a flow chart of the start up routine used by the control system;

FIGS. 8*a*, 8*b* and 8*c* are a flow chart of the menu display mode routine used by the control system;

Figure 1A:
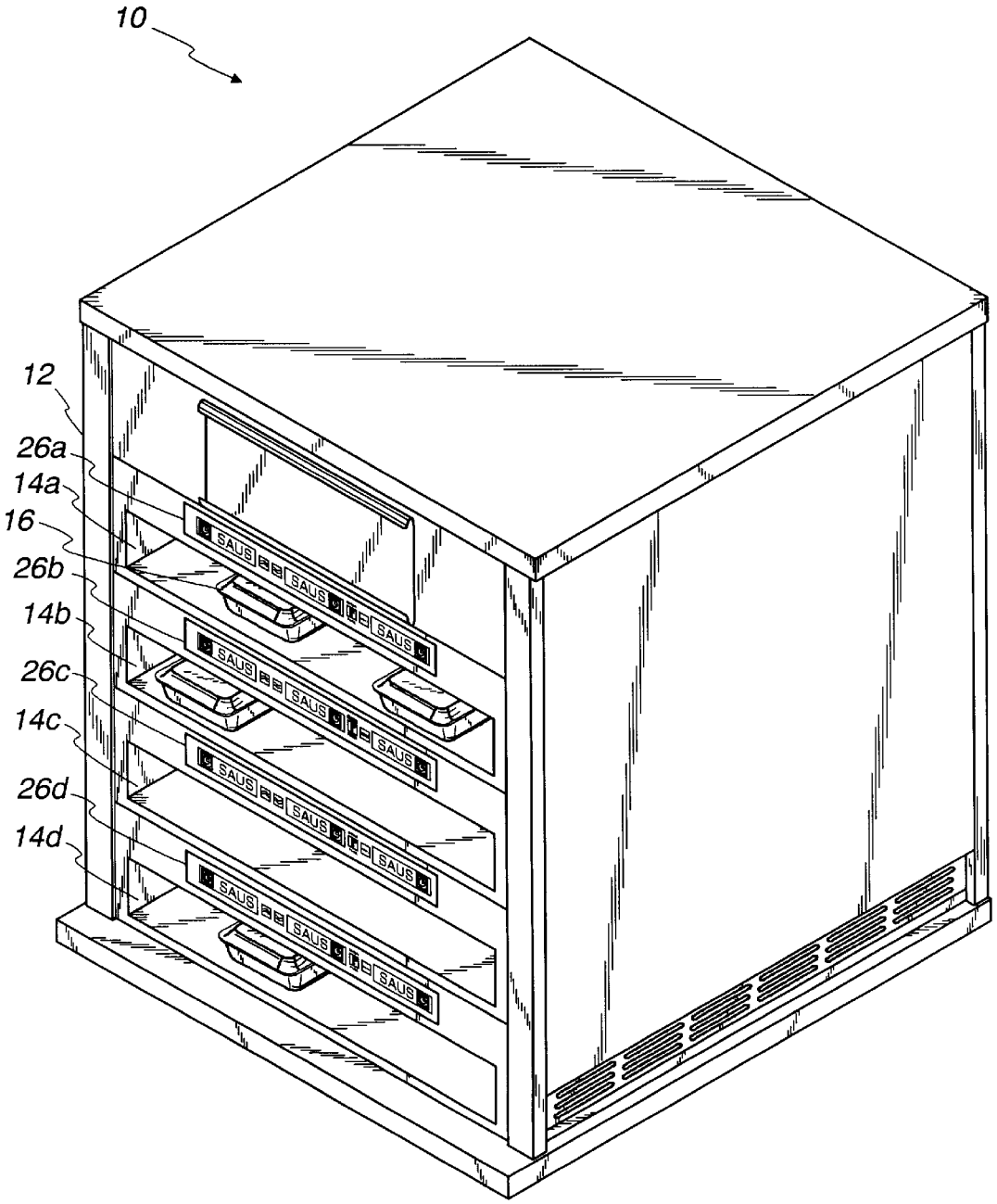
FIG. 1*a* is a perspective view of the holding cabinet.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternative falling within the spirit and scope of the invention as defined by the appended claims.

DETAILED DESCRIPTION OF THE INVENTION

Turning now to the drawings, FIGS. 1*a* through 1*g* illustrate the preferred embodiment for a food holding or warming cabinet 10. The holding cabinet 10 has a housing 12 with a plurality of passageways or slots 14*a–d*. Each passageway 14*a–d* is capable of receiving at least two food containers or trays 16. The food containers 16 may contain typical "fast food" items such as sausage, egg, bacon, Canadian bacon, muffins, biscuits, burritos, hamburger patties, chicken patties, chicken nuggets, and fish. As illustrated in FIG. 1*a*, the holding cabinet 10 has four passageways 14*a–d*, and each passageway 14*a–d* is capable of receiving three trays 16 of food. Of course, the holding cabinet may have more or less than four passageways, and each passageway may be capable of receiving more or less than three trays of food.

Figure 1B:
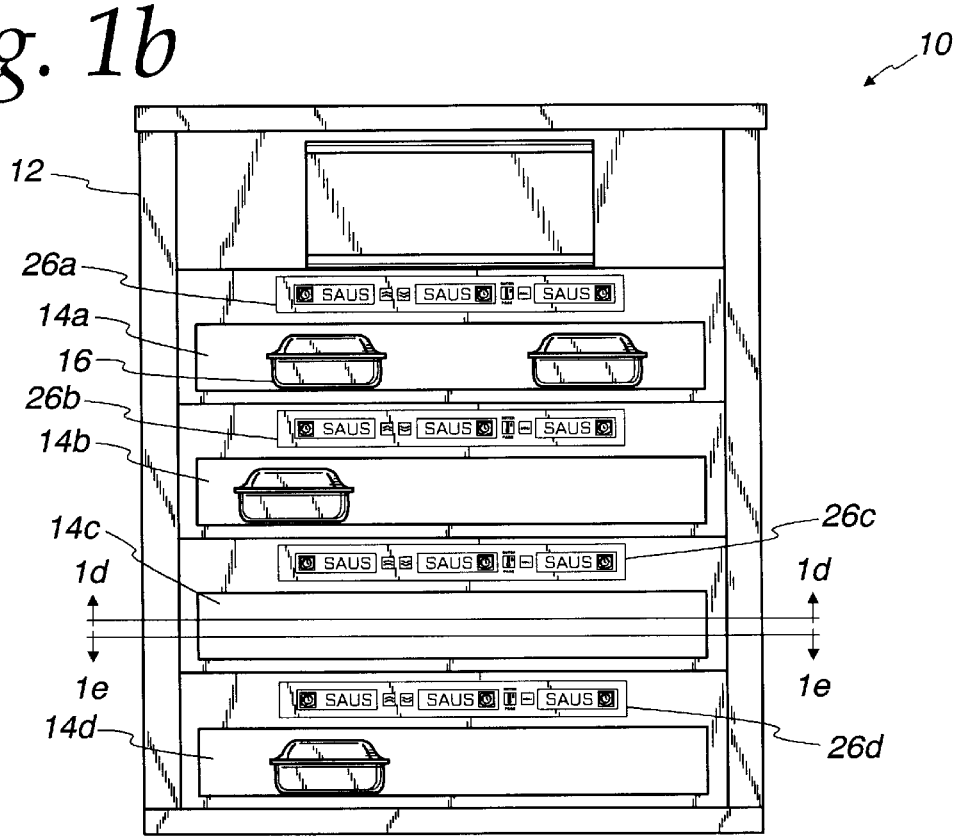
FIG. 1*b* is a front view of the holding cabinet of FIG. 1*a;*
Figure 1C:
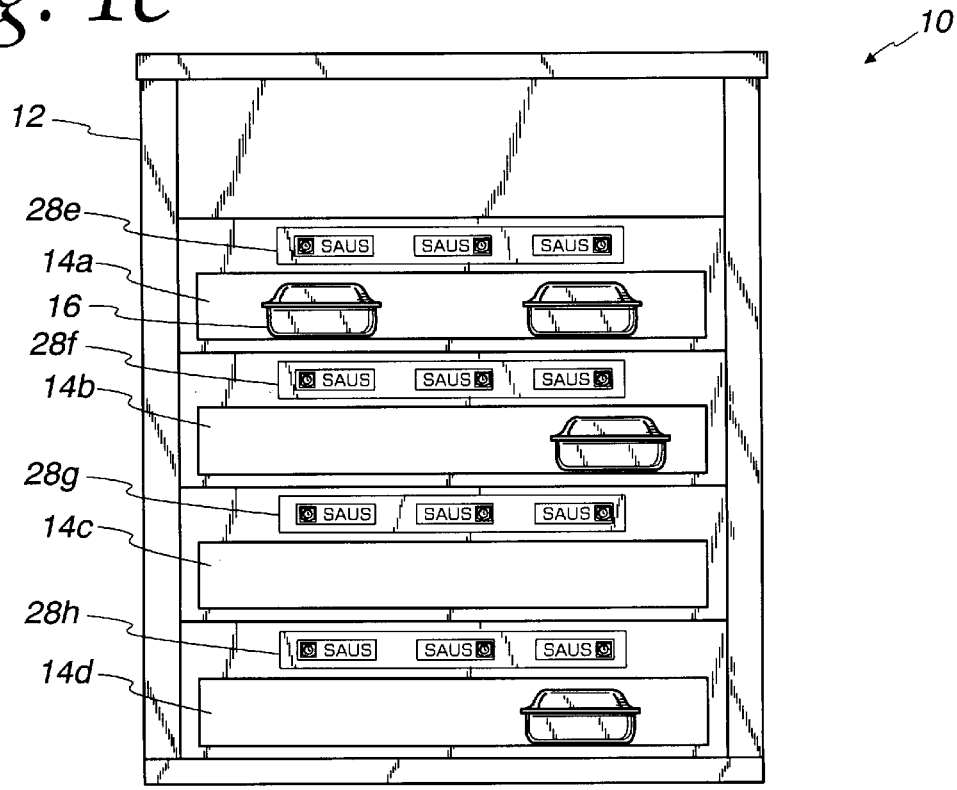
FIG. 1*c* is a rear view of the holding cabinet of FIG. 1*a;*

In the preferred embodiment, each passageway 14*a–d* has a pass-through structure. The front view shown in FIG. 1*b* and the rear view shown in FIG. 1*c* illustrate the passthrough structure of the passageways 14*a–d* with the food trays 16 being accessible on either the front or the rear side of the holding cabinet 10. Because the passageways 14*a–d* have a pass-through structure, one operator may insert food trays 16 at a workstation on the front side of the holding cabinet 10, and another operator may remove food trays 16 at a second workstation on the rear side of the holding cabinet 10. The pass-through arrangement allows efficient assembly line structure in a fast-food kitchen. In an alternative embodiment, the passageways do not have a pass-through structure but rather are structured to have only a single opening. In this alternative embodiment, the food trays are accessible from only one side.

Figure 1D:
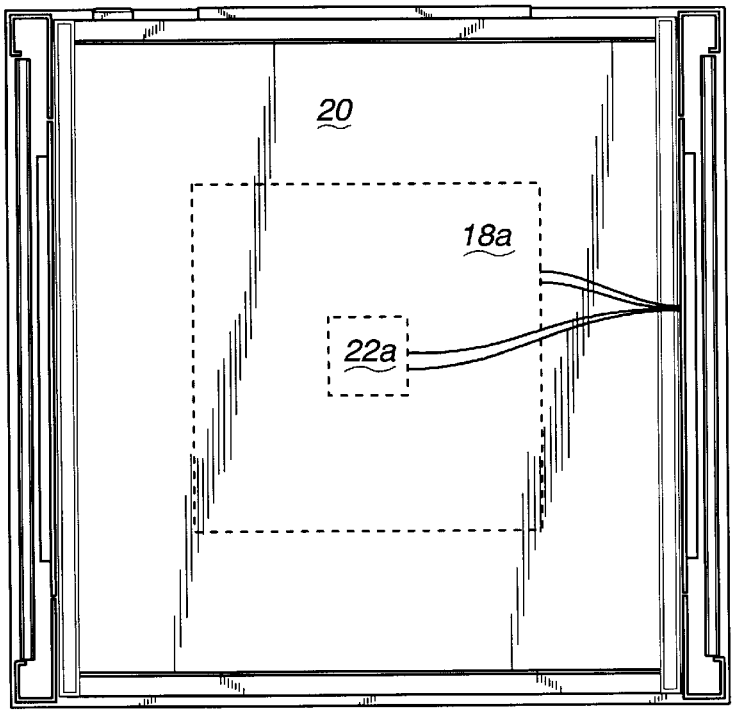
FIG. 1*d* is a bottom view of a passageway along line 1*d*—1*d* in FIG. 1*b;*
Figure 1E:
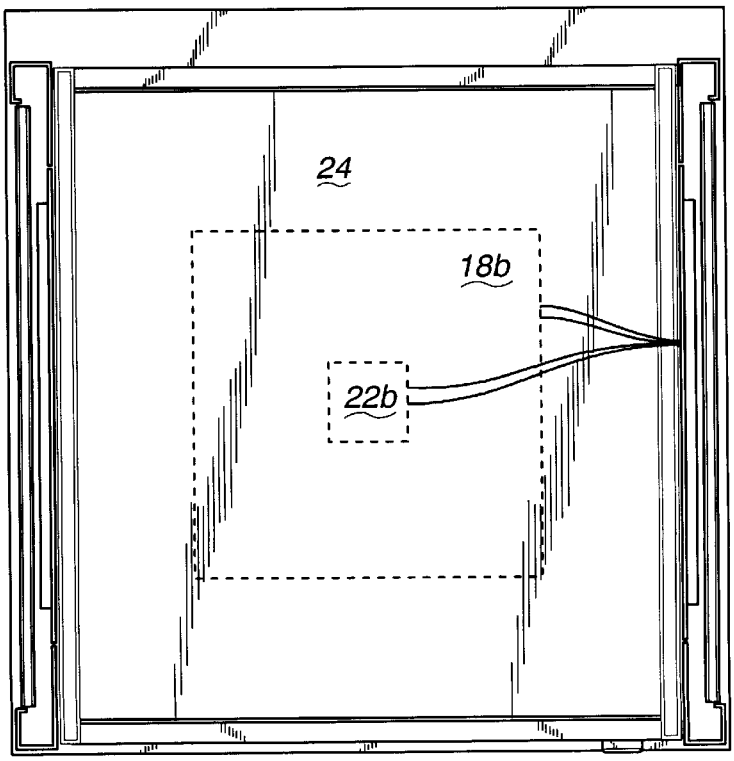
FIG. 1*e* is a top view of a passageway along line 1*e*—1*e* in FIG. 1*b;*

Each passageway 14*a–d* in the holding cabinet 10 contains two variable heating elements or heater plates 18*a* and 18*b*. The heater plates 18*a* and 18*b* are flat plates respectively located at the top and bottom walls of each passageway 14*a–d*. Any heater elements well known to those of ordinary skill in the field can be used. FIG. 1*d* illustrates the top wall 20 of a passageway, and FIG. 1*e* illustrates the bottom wall 24 of a passageway. A control system, described in detail hereinafter, provides power to the heater plates 18*a* and 18*b* to maintain a predetermined temperature range within the passageway 14. RTD temperature sensing elements 22*a* and 22*b* respectively are mounted to each heater plate 18*a* and 18*b*. The RTDs 22*a–b* provide temperature feedback signals to the control system. Using the temperature feedback, the control system is capable of initiating various alarm sequences to alert operators if the passageway temperature rises above or falls below desired parameters. The control system individually controls the top heater plate 18*a* and the bottom heater plate 18*b* in each passageway

14*a–d* for separate temperature set points. The multi-temperature control properly maintains the temperature of each passageway and accordingly the food stored in each passageway. Of course, the temperature set points at the top and bottom heater plates 18*a* and 18*b* may be identical. In an alternative embodiment, the control system jointly controls the heater plates in each passageway.

In addition to heater plates 18*a* and 18*b* and the RTDs 22*a–b*, the cabinet 10 comprises at least one display panel per passageway 14*a–d*, a display driver 30*a–d* associated with each display panel, and a master control 36. In FIG. 1*b*, the front side of the holding cabinet 10 has four front display panels 26*a–d*. Each of the four passageways 14*a–d* has a corresponding front display panel 26*a–d* positioned directly above the respective passageway 14*a–d*. Each of the four pass-through passageways 14*a–d* also has a corresponding rear display panel 28*e–h* positioned directly above the respective passageway 14*a–d* on the rear side of the holding cabinet 10 as shown in FIG. 1*c*. Because both the front side and rear side of the cabinet 10 have displays, operators on the front side and operators at the rear side view substantially identical information to coordinate proper use of the food in the cabinet 10.

Figure 1F:
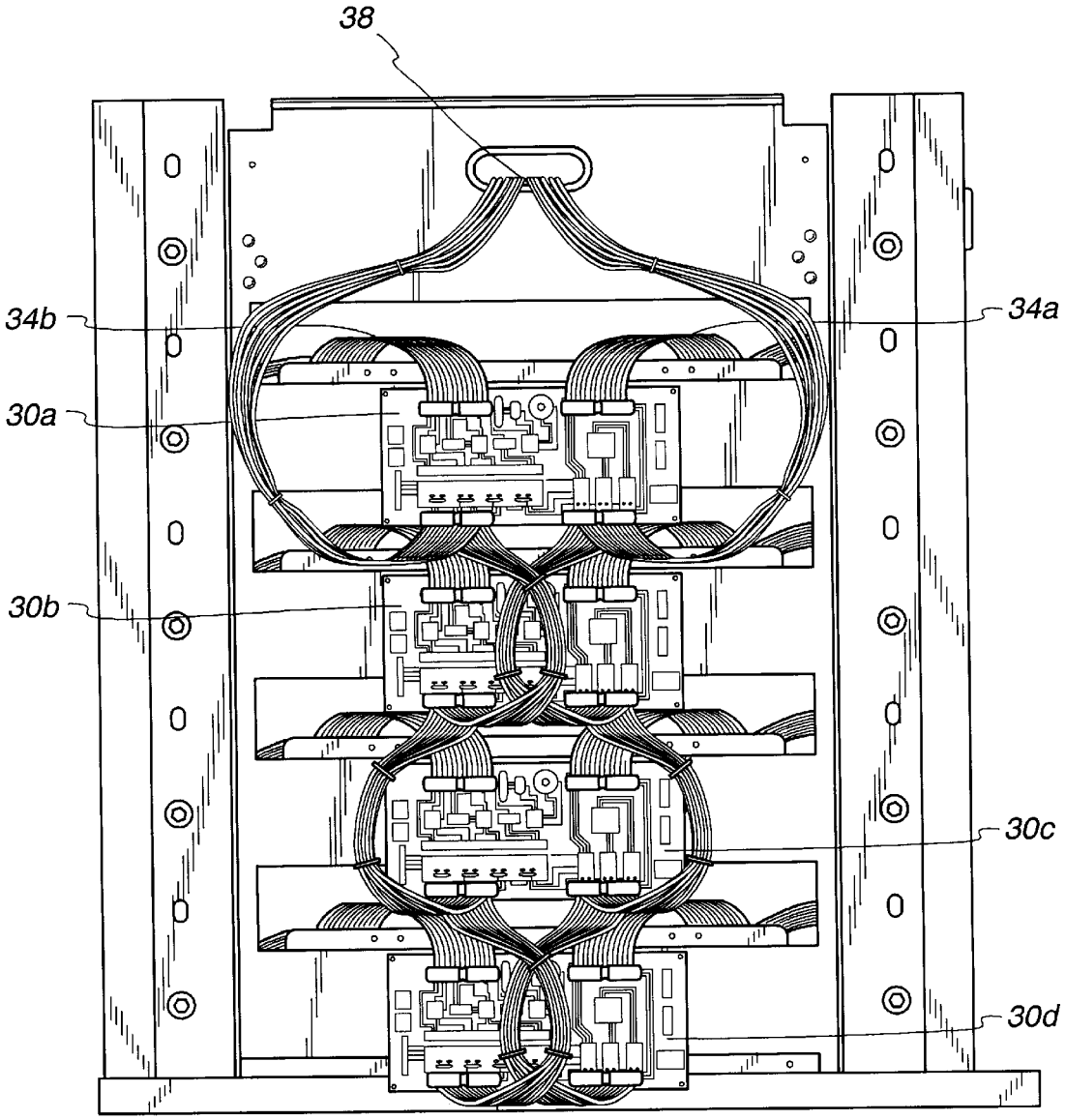
FIG. 1*f* is a side view of the holding cabinet of FIG. 1*a;*

The control system comprises one master control 36 and four display drivers 30*a–d* each of which control a respective pair of the front display panels 26*a–d* and the rear display panels 28*e–h*. Each display driver 30*a–d* is mounted on a printed circuit board although other forms of circuit construction such as an integrated circuit could be used as is well known in the field. The display drivers 30*a–d* are located remote from their corresponding front and rear display panels 26*a–d* and 28*e–h*. FIG. 1*f* illustrates the side of the holding cabinet 10 with the four display drivers 30*a–d* that control the four sets of display panels 26*a–b* and 28*a–b*. The display drivers 30*a–d* are mounted on the side of the cabinet 10. Flat cables connect each of the display panels 26*a–d* and 28*e–h* to their respective display drivers 30*a–d*. As shown in FIG. 1*f*, flat cable wiring 34*a* connects display driver 30*a* to front display panel 26*a*, and flat cable wiring 34*b* connects display driver 30*a* to rear display panel 28*e*. By locating the display drivers 30*a–d* remotely, the majority of the display control circuitry and the operator interface circuitry is located away from the heater plates 18*a* and 18*b* in cooler portions of the cabinet body. It has been found that the side area where the display drivers 30*a–d* are located is approximately 25° F. cooler than an area located adjacent to the display panels 26*a–d* and 28*e–h*. The cooler temperatures results in an extended service life of the circuitry of the display drivers 30*a–d*. In other embodiments, the display drivers may be located anywhere in the cabinet.

Figure 1G:
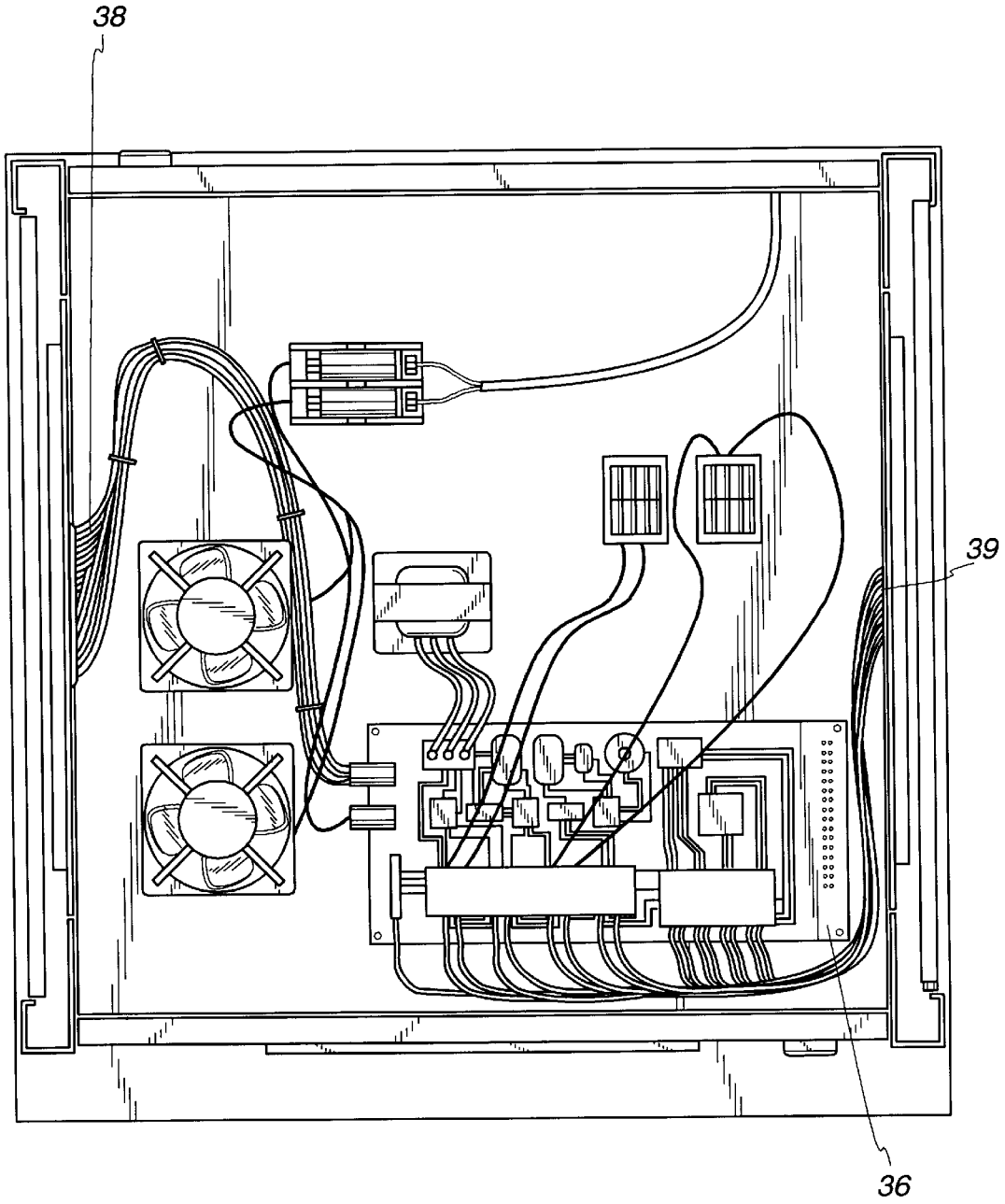
FIG. 1*g* is a top view of the holding cabinet of FIG. 1*a;*

FIG. 1*g* illustrates the top of the holding cabinet 10 with the top panel removed. As with the display drivers 30*a–d*, the master control 36 is mounted on a printed circuit board although other forms of circuit construction such as an integrated circuit could be used as is well known in the field. The master control 36 is located remote from the passageways 14*a–d* and their temperature extremes. A wiring harness 38 comprising multiple cables connects the master control 36 with the display drivers 30*a–d*. Another wiring harness 39 comprising multiple cables connects the master control 36 to the RTDs 22*a* and 22*b* and to the heater plates 18*a* and 18*b* of each passageway. By locating the master control 36 remotely, the master control circuitry is located away from the heater elements 18*a–b* in a cooler portion of the cabinet body resulting in an extended service life of the circuitry. In other embodiments, the master control 36 may be located anywhere in the cabinet.

Figure 2A:
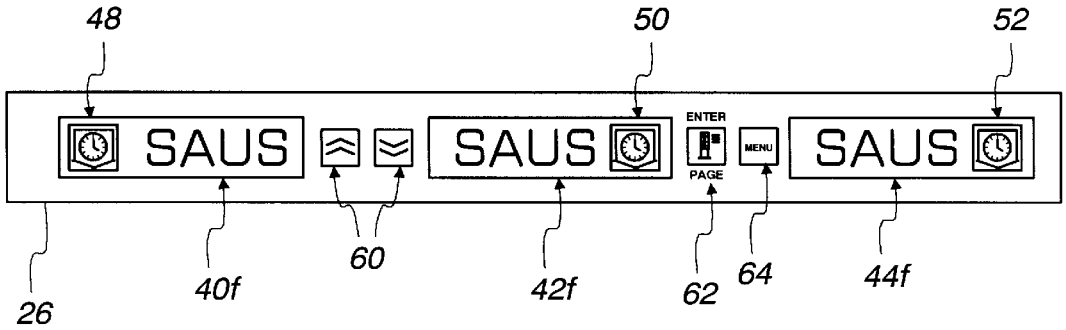
FIG. 2*a* is a front view of a preferred embodiment of the front display panel.
Figure 2B:
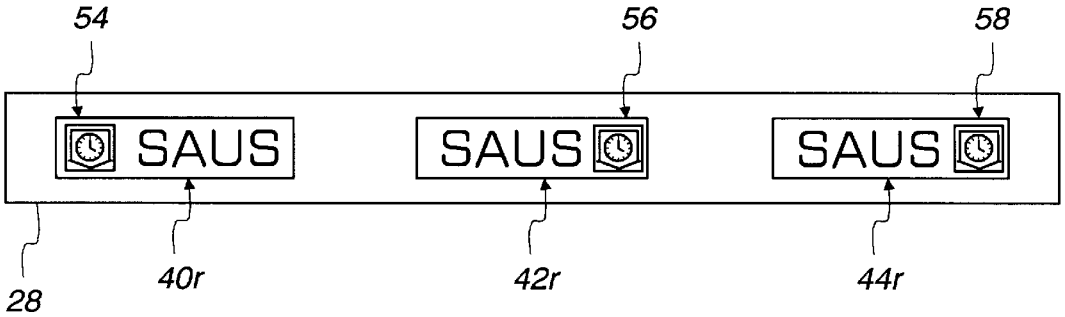
FIG. 2*b* is a front view of a preferred embodiment of the rear display panel.
Figure 2C:
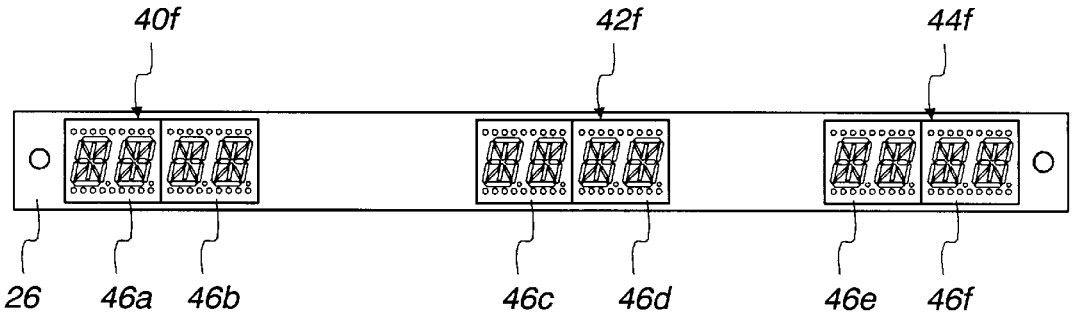
FIG. 2*c* is a front view of the display components in FIG. 2*b;*

FIG. 2*a* illustrates the preferred embodiment of a front display panel 26, and FIG. 2*b* illustrates the preferred embodiment of a rear display panel 28. Each of the front display panels 26*a–d* and the rear display panels 28*e–h* respectively are the same. Accordingly, for the sake of clarity, a single front display panel 26 and a single rear display panel 28 are discussed with respect to FIGS. 2*a–c* and FIG. 5. The display panels 26 and 28 illustrate alphanumeric messages to the operators such as the selected mode of operation, the category of food in the passageway, the time period for which the control system is maintaining the temperature set point, or the desired temperature. To display messages, the front and rear display panels 26 and 28 each contain three lighted displays 40*f*, 42*f*, 44*f* and 40*r*, 42*r*, 44*r* corresponding to three tray locations for the passageway. FIG. 2*c* illustrates the front display panel 26 wherein each of the three lighted displays 40*f*, 42*f* and 44*f* contain two lighted display sections respectively 46*a–b*, 46*c–d*, and 46*e–f*. The lighted display sections 46*a–f* are capable of displaying twelve characters on the display panel 26. Corresponding to the three tray locations for a passageway, the left portion has two lighted display sections 46*a–b*, the center portion has two display sections 46*c–d*and the right portion has two display sections 46*e–f*. Each lighted display section 46*a–f* contains a two 14-segment character displays. Each pair of lighted display sections 46*a–b*, 46*c–d*and 46*e–f* can display an alpha numeric character representation. The lighted display sections 46*a–f* consist of LEDs. Of course, any other forms of lighted display can be used. The circuitry associated with the lighted display sections 46*a–f* is part of the respective display drivers 30*a–d* remote from the associated display panels 26*a–d* and 28*e–h*. Flat cables connect the lighted display sections 46*a–f* to the respective display drivers 30*a–d*. The rear display panel 28 has a corresponding arrangement.

Not only do the display panels 26*a–d* and 28*e–h* provide messages to the operators, but they also have keypads for operator interface. Each of the front display panels 26*a–d* have timer keys 48, 50 and 52 respectively located adjacent to each of the three lighted displays 40*f*, 42*f*and 44*f*. Each of the rear display panels 28*e–h* have timer keys 54, 56 and 58 respectively located adjacent to each of the three lighted displays 40*r*, 42*r* and 44*r*. The timer keys 48 through 58 respond to operator input for starting and stopping the timer associated with each tray 16 and for turning off audible alarms all of which will be discussed in detail below.

As shown in FIG. 2*a*, the front display panel 26 provides additional operator interface not present on the rear display panel 28. Located between the left display 40*f* and the center display 42*f* are up/down arrow keys 60. The up/down arrow keys 60 allow the operator to increase/decrease displayed variables or change selections as will be discussed below. Additionally, a temperature/enter/page key 62 is located immediately right of the center timer key 50. The temperature/enter/page key 62 provides the operator with three functions: 1) display passageway temperature information, 2) enter operational changes, and 3) select page parameters in program mode. Between the temperature/enter/page key 62 and the right display 44*f* is a menu key 64. The menu key 64 allows the operator to select meal transitions such as breakfast to lunch, to select clean mode operation, to turn individual passageways on or off and to provide access to the program menu. The operation of the displays and keypads will be discussed in detail below.

In the preferred embodiment, the control system comprises a master control 36 that controls the four display drivers 30*a–d* or slave boards. Each display driver 30*a–d* receives messages to be displayed from the master control 36 and displays those messages on the lighted displays 40*f*, 42*f*, 44*f*, 40*r*, 42*r* and 44*r*. The display drivers 30*a–d* also read the keypads described above and transmit the keyed information to the master control 36. The master control 36 controls all of the operations of the cabinet 10 directing the individual display drivers 30*a–d* to display certain messages for their passageway location. One alternative embodiment for the control system would be four independent display drivers. Each display driver would be independently controlling only its corresponding passageway's display panel. Interface between the four independent display driver boards would allow the four display drivers to share information. Another alternative embodiment would be to have a single master control that performs all of the functions of the display drivers and master control. Other embodiments would distribute some of the operations of the display drivers to the master control and vice versa. In another alternative embodiment, a single display driver or two display drivers communicating with the master control could perform all of the functions of the four display drivers.

Figure 3:
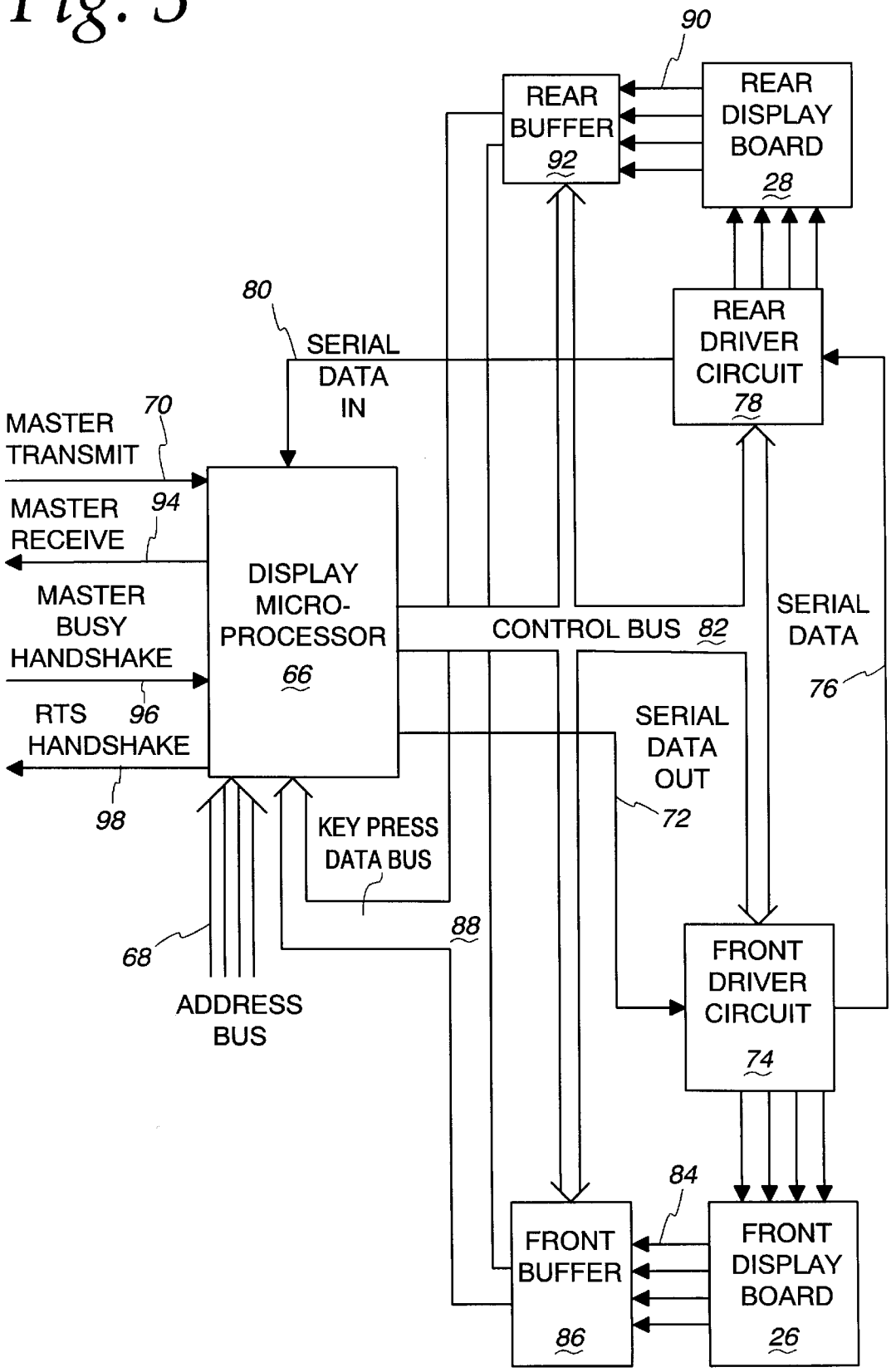
FIG. 3 is a block diagram of the display driver of the control system.

FIG. 3 illustrates the block diagram of the one of the display drivers 30*a–d* for the preferred embodiment of the control system with one master control board 36 and four slave or display drivers 30*a–d*. Since each of the slave or display drivers 30*a–d* are the same, only one is discussed in FIG. 3. The display driver 30 interfaces with the front and the rear display panels 26 and 28 and the master control 36. A display microprocessor 66 on the display driver 30*a–d* communicates with the master control 36 and interfaces with the display panels 26 and 28. The master control 36 sends out data with a communication protocol in a header identifying which display driver 30*a–d* and corresponding display microprocessor 66 the master control 36 wants to talk to. The communication protocol contains the display driver's 30*a–d* address, commands to be performed such as display message or display product time, and the message in ASCII format to be displayed on the front and rear display panels. The four display drivers 30*a–d* read the address data, and the one display driver 30*a–d* with the matching address reads the following data from the master control 36 and the other three ignore the communication. The preferred embodiment for the display microprocessor 66 is a Motorola IC 68HC705 microprocessor, although any similar microprocessor known to one of ordinary skill in the art may be used.

Because the master control 36 communicates with four display drivers 30*a–d*, each display driver 30*a–d* has an unique address. In the preferred embodiment, the display microprocessor 66 determines its address or passageway location from four lines of an address bus 68. The address bus 68 is built into the wire harnessing 38 which connects the display driver 30 to the master control 36. In the wire harnessing, one of the four lines that corresponds to the passageways position 1, 2, 3 or 4, is shorted to ground, and the remaining three lines are tied to a logic high. When the display microprocessor 66 powers up, the four address bus lines 68 are read with the grounded line indicating the passageway position. Therefore, at every power-up, the display microprocessor 66 determines and stores in memory its passageway position in the cabinet 10. This allows the display drivers 30*a–d* to be removed and interchanged without any special programming. In other embodiments, the passageway position of the display drivers 30*a–d* could be programmed and stored in memory.

The display microprocessor 66 receives message information from the master control 36 over a master transmit line 70. The master transmit line 70 is a common line shared by every display microprocessor 66 in the cabinet 10. The message information is in ASCII character format consisting of twenty-four characters, twelve for the front display panel and twelve for the rear display panel. The display microprocessor 66 translates the ASCII formatted data into bit patterns, as is well known to one of ordinary skill in the art, for display on the LEDs of the display sections 46*a–f* of the display panels 26 and 28.

To display the message supplied by the master control 36 on the display panels 26 and 28, the display microprocessor 66 serially transmits over a serial data out line 72 the bit patterns to a front driver circuit 74 and over serial data line 76 to a rear driver circuit 78. The display microprocessor 66 sets the correct position of the character for display on the display sections 46*a–f* for the front display panel 26 (see FIG. 2*c*) and the corresponding display sections (not shown) for the rear display panel 28. The display microprocessor 66 shifts out serially one character at a time to the driver circuits 74 and 78. The display microprocessor 66 then strobes the driver circuits 74 and 78 to send the character to the proper display section. Once one character has been displayed, the display microprocessor 66 moves to the next character until the display panels 26 and 28 illustrate the message supplied by the master control 36. The serial data from the display microprocessor 66 flows through serial data out line 72 to the front driver circuit 74 and then through serial data line 76 to the rear driver circuit 78 and finally through serial data in line 80 back into the display microprocessor 66. The display microprocessor 66 may monitor the serial data in line 80 to verify the shifting of the characters to the display panels 26 and 28.

A control bus 82 connects the display microprocessor 66 to the driver circuits 74 and 78. The control bus 82 provides digital lines for control signals to enable or disable the shifting of serial character data to the driver circuits 74 and 78. The control bus 82 also provides a path for a latch enable signal from the display microprocessor 66 to strobe the data to the display sections 46*a–f*.

The display microprocessor 66 coordinates the illustration of the message and also reads operator input signals. When the operator presses one of the keys on the front display panel 26, the key press signals transmit over front key lines 84 to a front buffer 86. The key press signals are stored in the front buffer 86 until the display microprocessor 66 strobes the front buffer 86 via the control bus 82. When the front buffer 86 is strobed, the key press signal travels over a key press data bus 88 to the display microprocessor 66. A key press signal from the rear display panel 28 transmits over rear key lines 90 to a rear buffer 92. The key press signals are stored in a rear buffer 92 until the display microprocessor 66 strobes the rear buffer 92 via the control bus 82. When the rear buffer is strobed, the key press signal travels through the key press data bus 88 to the display microprocessor 66. The key press signals from the front and rear display panels 26 and 28 are placed on the common key press data bus 88 because the display microprocessor 66 selects which buffer can transmit over the bus 88.

The display microprocessor 66 forwards the key press signals to the master control 36 via a master receive line 94. The communication protocol for transmitting the key press to the master control 36 consists of a header with hex value 55, the display driver's address, and the key press identification data. Two handshake lines coordinate communication between the display microprocessor 66 and the master control 36. A master busy handshake line 96 signals the display microprocessor 66 that the master control 36 is busy and cannot receive communications on the master receive line 94. The master busy handshake line 96 is active low, so when the master busy line 96 is low, the display microprocessor 66 cannot initiate communications to the master control 36. When the master busy handshake line 96 is high, the display microprocessor 66 can transmit key press signals over the master receive line 94. A RTS handshake line 98 signals the display microprocessor 66 that one of the other display microprocessors is transmitting to the master control 36. The RTS handshake line 98 is active low, so when the RTS line 98 is low, the display microprocessor 66 cannot initiate communications to the master control 36. When the RTS line 98 is high, the display microprocessor 66 can transmit key press signals over the master receive line 94. The RTS handshake line 98 coordinates data transfer between the four display microprocessors 66 and the master control 36 to avoid serial link contention. The RIS handshake line 98, master receive line 94 and master busy handshake line 96 are each common lines shared by every display microprocessor 66 in the cabinet 10.

Figure 4:
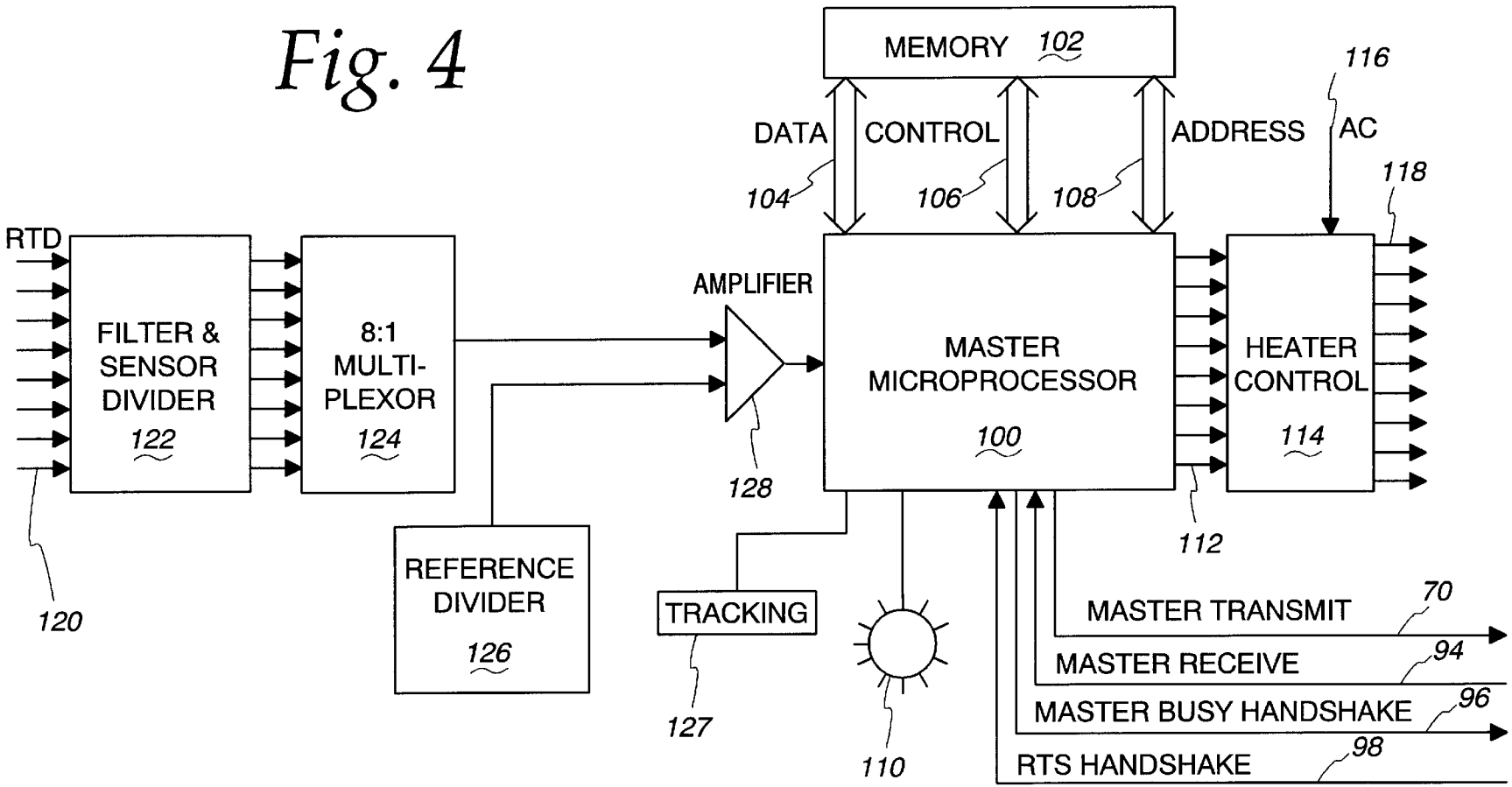
FIG. 4 is a block diagram of the master control of the control system.

FIG. 4 illustrates a block diagram of the preferred embodiment of the master control 36. A master microprocessor 100 controls the operation of the entire holding cabinet 10. The preferred embodiment for the master microprocessor 100 is a Motorola IC68HC16Z1CFC16 microprocessor, although any similar microprocessor known to one of ordinary skill in the art may be used. The master microprocessor 100 directs the four display microprocessors 66 to display certain messages, analyses operator key press signals and controls the temperature of each passageway 14*a–d*. The master microprocessor 100 executes a cabinet control program to control the operations of the holding cabinet 10. The operations of the cabinet control program will be discussed in detail below. The cabinet control program is stored in a memory 102 which the master microprocessor 100 interfaces through a data bus 104, a control bus 106 and an address bus 108. In the preferred embodiment, the memory 102 is composed of three separate memory devices 1) an EPROM stores the cabinet control program in permanent memory, 2) an EEPROM stores operator programmable data such as entries made in the program mode described below, and 3) a RAM stores temporary data from the cabinet control program's execution; although, other memory device known to one of ordinary skill in the art may be used. When the cabinet 10 is powered up, the master microprocessor 100 performs the cabinet control program to operate the holding cabinet 10.

Through the operation of the cabinet control program, the master microprocessor 100 communicates with the four display microprocessors 66 via the master transmit line 70, the master receive line 94, the master busy handshake 96 and the RTS handshake 98. The master microprocessor 100 sends display messages in ASCII character format to the display microprocessors 66. In return, the display microprocessors 66 relay key press signals to the master microprocessor 100 conveying operator input.

In addition to controlling the messages displayed on the display panels 26 and 28, the master microprocessor 100 controls the temperature at the top and bottom of each of the four passageways 14*a–d*. To maintain the temperature of the passageways 14*a–d* within the predetermined temperature range, the master microprocessor 100 individually controls each of the eight heater plates 18*a–b* through the eight heater control lines 112. The heater control lines 112 connect the master microprocessor 100 to a heater control circuit 114. The heater control circuit 114 is a group of switches controlled by the master microprocessor 100. One phase of the AC power line 116 is wired in parallel to all of the heater plates 18 over one of the heater power lines 118. The other phase of the AC power line 116 is connected to eight zero-crossover triac circuits, a type of solid state switch known in the art. Other switches including mechanical or solid state relays as known in the art may also be used. When the master microprocessor signals the heater control circuit 114 to provide heat to a certain heater plate 18, the switch corresponding to the desired heater plate 18 connects the other phase of the AC power line 116 to the heater power lines 118. With both phases of the AC power line connected to the heater plate 18, the circuit is complete and the plate 18 converts the AC power into heat for the holding cabinet passageway 14*a–d*.

The master microprocessor 100 monitors the temperature at the top and bottom of each passageway 14*a–d*. To determine the temperature, the RTDs 22 provide temperature signals to the master control 36 over eight RTD lines 120. The RTDs 22 are temperature sensitive resistors whose resistance changes with changes in temperature. Basically, the resistance of the RTD 22 and in turn the temperature that resistance represents is determined using a conventional bridge circuit as known in the art. The RTD lines 120 along with a common analog ground connect each RTD 22 to the bridge circuit. The bridge circuit consists of two voltage divider circuits, a sensor-divider and a reference-divider, wired in parallel. Each voltage divider circuit consists of two resistors wired in series for a total of four resistors. The reference-divider consists of two precision resistors whose resistance value is known. The voltage supplied for the bridge circuit is a know reference voltage of approximately five volts. The sensor-divider consists of a precision resistor whose resistance value is known and the RTD temperature signal or resistance that is the only unknown quantity.

The reference voltage supplied to the bridge circuit is referenced tracked as known in the art. Factory calibration procedures during construction of the control system store the reference voltage value in memory. The reference voltage value may change with changing conditions, so the reference voltage value is tracked with tracking circuit 127. The tracking circuit 127 is a voltage divider that divides the reference voltage value and supplies the divided value to the master microprocessor 100. The master microprocessor 100 compares the divided value to the calibrated value stored in memory. The percentage change between the divided value and the calibrated value is used to adjust the temperature signal exiting the amplifier 128.

Before the RTDs 22 are connected to their respective bridge circuit, the temperature signals on the RTD lines 120 are filtered by a filter/sensor-divider circuit 122 to remove any noise on the signal from the RTDs 22. The signals pass through a simple low pass RC filters as known in the art with a cut-off frequency of approximately three hertz. Any filter known in the art may be used to filter out low frequency and high frequency noise.

The cabinet 10 has eight RTDs 22, so eight bridge circuits determine the resistance of the eight RTDs 22. Because the reference-divider can be the same for all of the eight bridge circuits, a single reference-divider circuit 126 provides the reference side for all eight bridge circuits. The eight filtered temperature signals make up the unknown resistance of the sensor-divider in the filter/sensor-divider circuit 122. The divider voltage of the eight sensor-dividers are then directed through an eight to one multiplexor 124.

By feeding the analog output end of the multiplexor 124 and the divider voltage of the reference-divider circuit 126 into a differential amplifier 128, a differential voltage is amplified. The differential voltage between the sensor voltage and the reference voltage is the change in voltage due to the change in temperature sensed by the RTD 22. The amplifier not only amplifies the differential voltage, but also converts the signal to ground referenced voltage for transmission to the master microprocessors 100.

Instead of using the bridge circuits, another embodiment for reading the temperature signals from the RTDs would be to muliplex a constant current source into each of the RTDs. With a known value for current, the RTD voltage is directly related to the RTD resistance which is directly related to temperature allowing the temperature at the heater plate to be readily calculated.

The signal exiting the amplifier 128 is sent to the master microprocessor 100. The master microprocessor 100 has analog to digital circuitry to read the signals for each of the passageway positions. Using the signals or temperature data supplied by the RTDs 22, the master microprocessor 100 determines the temperature sensed by the RTD 22. If the temperature of the heater plate is not within a predetermined range or setpoint, the microprocessor will signal the heater control 114 to supply heat to the passageway and will sound an audible alarm 110 if the temperature meets an alarm condition as described below.

The cabinet control program operates the holding cabinet 10. The cabinet control program operates in several distinct control modes including: (1) operator mode; (2) manager mode; (3) service mode; (4) factory mode; and (5) Chromalox mode.

The operator mode provides an operator with normal day to day operations for the holding cabinet 10. The operator mode allows the operator to start, acknowledge, and reset product timers; select breakfast or lunch menus; select the clean mode, turn on or off the passageways, and configure the passageway product selections.

When the operator turns on the holding cabinet 10, the lighted displays illustrate the name and version number of the cabinet control system for five seconds. The lighted displays then alternate the "SLOT TEMP LOW" message and the default breakfast product selection mnemonic at the lowest display intensity until the passageways are heated to the predetermine temperature range or setpoints for the default product selections. The default breakfast product selection for slot 1 are "SAUS" representing sausage for the left lighted display, "SAUS" for the center lighted display, and "SAUS" for the right lighted display; the default product selections for slot 2 are "ROUN" representing round egg for the left lighted display, "ROUN" for the center lighted display, and "CBAC" representing Canadian bacon for the right lighted display; the default product selections for slot 3 are "SCRA" representing scrambled egg for the left lighted display, "FOLD" representing folded egg for the center lighted display, and "CBAC" representing Canadian bacon for the right lighted display; the default product selections for slot 4 are "NONE" representing an open tray location for the left lighted display, "BISC" representing biscuit for the center lighted display, and "NONE" representing an open tray location for the right lighted display. The operations of the cabinet control program at power on are more fully described below in conjunction with FIGS. 6*a* and 6*b*.

In the operator mode, the operator may use the default product selections illustrated or change to new product selections. To change the product selections illustrated, the operator enters the program mode to select the products to be placed in each passageway location. To enter the program mode, the operator presses and holds the menu key for at least five seconds. When the program mode is entered, the lighted displays shows a "PROG MODE" message.

At the "PROG MODE" message, the operator presses the temperature/enter/page key to scroll to the correct passageway illustrated on the lighted displays with "SLOT 1" representing passageway 14*a*, "SLOT 2" representing passageway 14*b*, "SLOT 3" representing passageway 14*c* and "SLOT 4" representing passageway 14*d*. Once the desired passageway is illustrated, the operator presses the menu key to scroll the meal, tray position on the lighted displays, for example "BFST LEFT SAUS, BFST CENT SAUS, BFST RGHT SAUS". When the desired meal and tray position are illustrated, the operator uses the up/down arrow keys to scroll the available product selections, for example "BFST LEFT SAUS, BFST LEFT ROUN, BFST LEFT FOLD". The breakfast product selections are SAUS representing sausage, ROUN representing round egg, FOLD representing folded egg, SCRA representing scrambled egg, RBAC representing regular bacon, CBAC representing Canadian bacon, MUFF representing muffin, BISC representing biscuit, BURR representing burrito. The lunch product selections are 10-1 representing regular hamburger patties, 4-1 representing quarter pound hamburger patties, GRCK representing grilled chicken, NUGG representing chicken nuggets, FISH representing fish and McCK representing chicken patties. Of course, other product solutions can be used.

When the operator changes the product selection, the master microprocessor changes the holding temperature for the passageway Each product selection has a preset holding temperature stored in memory. The product selected in the left lighted display determines the holding temperature for the entire passageway. Only products that have holding temperatures with 5° F. of the left display's product selection will be displayed for the center and right lighted displays. The master microprocessor acquires the holding temperature for the specific product selection from the memory. If the holding temperature of the new product selection is different from the prior product selection, the master microprocessor adjusts the passageway temperature accordingly. During transition to the new holding temperature, the operator may be alerted with alarms which will be described below.

The operator may continue to change the product selections in the manner described above until all of the lighted displays illustrate the desired product selections. To exit the program mode, the operator holds the menu key for five seconds. If no key entries occur for five minutes in the program mode, the master microprocessor exits the program mode.

Once the desired product selections are illustrated on the lighted displays and the passageways are heated to their predetermined temperatures, the operator may place food trays into the tray locations corresponding to their lighted displays. When the operator places a tray of food in the left tray location, he activates a left timer by pressing the left timer key. Once the left timer key is pressed, the left product timer counts down from a predetermined maximum holding time for the product selection. In an alternative embodiment, the manual timer key is replaced by at least one sensor positioned within the passageway to detect the presence of a tray and appropriately start the timers. The sensors detect the placement of the tray into the left tray position of the passageway and provide a start signal for the left timer. When the master microprocessor receives the left timer start signal, the left product timer counts down from the predetermined maximum holding time. The master microprocessor acquires the predetermined maximum holding time for the specific product selection from the memory. The memory stores the holding times for all product selections. When the operator places an additional tray of food into the center tray location, he activates the center product timer by pressing the center timer key. In the alternative, when the sensors detect the placement of a tray of food in the center tray location and provide the center timer start signal to the master microprocessor, the center product timer starts counting down from the predetermined maximum holding time.

Figure 5:
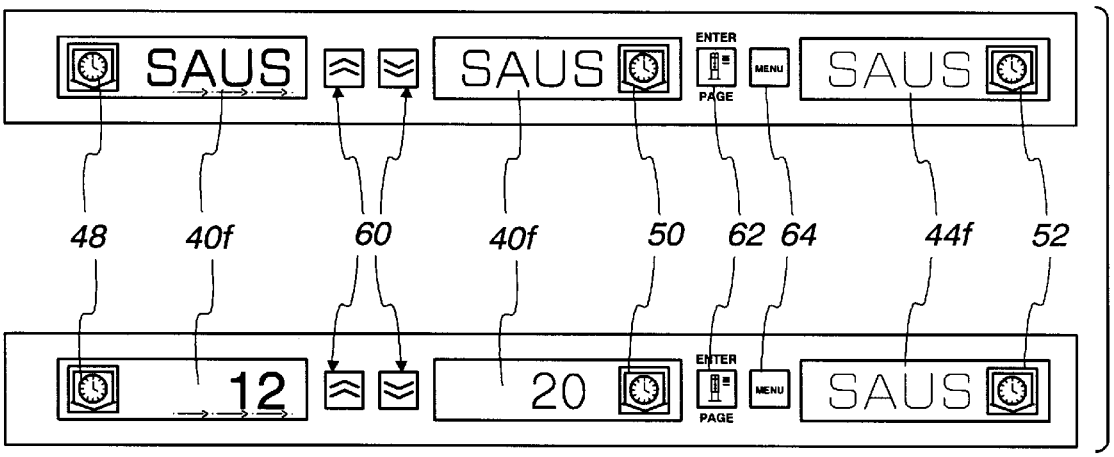
FIG. 5 is a front view of the front display panel in the operation mode.

FIG. 5 illustrates the operation mode for the front display board 26. In the present example, the operator has activated the left product timer 48 and the center product timer 50 as described above. The left and center lighted displays 40*f* and 42*f* respectively alternative illustrating the product selection for one second and then illustrating the holding time remaining for five seconds. To grab the operator's attention, the left display 40*f* indicates the use first product selection. The use first product selection is the product timer for a category of food with the least amount of holding time remaining. The use first lighted display distinguishes itself from the other lighted displays with the same product selection by lighting its display at the brightest level of display intensity and running dots on the display. The center display 42*f* maintains the same product selection as the left display 40*f* and has more holding time remaining than the left display 40*f*. The center display 42*f* is lighted at a medium level of display level intensity to indicate the active timer that is not the use first product selection. The right display 44*f* shows just the product selection at a lowest level of display intensity to indicate an inactive timer.

The product timers count down from their preset values for the product selection and the lighted displays illustrate the product selection mnemonic and holding time remaining as described above. When the operator removes the food tray 16, the operator presses the timer key corresponding to that tray to turn off the active product timer. In the alternative embodiment with sensors to detect the presence of the trays, the sensors detect the removal of the tray from its corresponding tray position of the passageway and provide a stop signal to the master microprocessor for the corresponding timer. When the timer key is press, the lighted display changes to the inactive status illustrating only the product selection at low intensity. The lighted display of the active product timer with the least holding time becomes the new use first lighted display.

When one of the use first timers expires, an audible alarm alerts the operator and the lighted display illustrates "00". All other lighted displays in the cabinet 10 will switch to the lowest intensity level until the operator turns the alarm off and clears the expired timer by pressing the corresponding timer key. If other timers expire in the meantime, the audible alarm continues after clearing of the first alarm, and the lighted display of the new expired timer illustrates "00". When all expired timers are cleared, the lighted displays of the remaining active timers return to active status, and the use first display is the next timer with the least amount of holding time remaining.

The operator mode allows the operator to change the product selection of an inactive lighted display from breakfast to lunch. To change from breakfast to lunch, the operator presses the menu key to scroll the lunch product selections on the lighted display. To activate the meal selection illustrated, the operator presses the temperature/enter/page key. If the temperature/enter/page key is not pressed within five seconds of the menu key press, the product selection will return to the prior breakfast meal selection. Any active timers will not change to the new meal selection until the timers are stopped or reset. If the new meal product selection has a holding temperature different from the current product selection, a temperature alarm occurs with the lighted displays alternating the product selection and the "SLOT TEMP LOW" or "SLOT TEMP HIGH" message depending if the passageway temperature is lower or higher respectively than the new product holding temperature while the passageway temperature is changed.

The operator mode further allows the operator to chose the clean mode. The clean mode changes the temperature of all passageways in the cabinet to 125° F. to allow the passageways to be safely cleaned by the operator. To enter the clean mode, the operator presses the menu key to scroll to the clean mode message "CLN MODE". The operator presses the temperature/enter/page key to activate the clean mode. When the clean mode is activated, all passageways in the cabinet change to the clean mode. In the clean mode, if any passageway temperature is above 125° F., the lighted displays will alternate a "SLOT CLN MODE" and a "NOT SAFE YET" message until the passageway temperature is 125° F. When the passageway temperature decreases to 125° F. the lighted displays show "SAFE TO CLN". If the temperature/enter/page key is not pressed within five seconds of scrolling to the "CLN MODE" message, the lighted displays return to their previous product selections.

To exit the clean mode, the operator presses the menu key to illustrate the "EXIT CLN MODE" message. The operator then presses the temperature/enter/page key to return to normal operation. The lighted displays alternatively illustrate "SLOT TEMP LOW" and the production selection until the temperature in the passageway rises to the preset holding temperature. If the temperature/enter/page key is not pressed within five seconds of the "EXIT CLN MODE" message, the passageway will return to the clean mode.

In the operator mode, the operator may turn the heater plates of a passageway off by scrolling with the menu key to the message "TURN SLOT OFF" on the lighted displays. To accept the message, the operator presses the temperature/enter/page key. When the passageway is turned off, the lighted displays message "SLOT IS OFF", and the master microprocessor no longer supplies the heater plates in the passageway with power. If the temperature/enter/page key is not pressed within five seconds of the "TURN SLOT OFF" message, lighted displays return to displaying the product selections. The operator may turn on the heater plates of a passageway by pressing the menu key to scroll to the "TURN SLOT ON" message on the lighted displays. To turn the passageway on, the operator presses the temperature/enter/page key. The master microprocessor will supply power to the heater plates of the passageway, and the lighted displays alternatively illustrate "SLOT TEMP LOW" and the product selection until the temperature rises to the predetermined holding temperature. If the operator does not press the temperature/enter/page key within five seconds of the "TURN SLOT ON" message, the passageway will return to the "SLOT IS OFF" status.

The operator mode provides for the display of passageway temperature information when the operator presses the temperature/enter/page key. When the temperature/enter/page key is successively pressed, the lighted displays illustrate the following information for the passageway: 1) top plate temperature "TOP TEMP 160", 2) bottom plate temperature "BOT TEMP 160", 3) top plate temperature set point "TOP TSET 160" and 4) bottom plate temperature set point "BOT TSET 160". After the bottom plate temperature setpoint is displayed, pressing the temperature/enter/page key another time or by pressing no key for five seconds returns the lighted displays to the previous illustration.

The cabinet control program provides the operator mode with five temperature alarms to alert the operator: 1) high temperature alarm, 2) low temperature alarm, 3) FDA alarm, 4) sensor alarm, and 5) rise time alarm. If an alarm condition occurs, an audible alarm sounds and the lighted displays alternate the product selection and the specific alarm message. During an alarm condition, the timers cannot be started.

If a passageway temperature is above or below the preset holding temperature limits for a product selection, the high temperature alarm or the low temperature alarm occurs respectively. The temperature in the passageway may be 5° F. greater than or less than the predetermined temperature setpoint, for example if the top heater plate setpoint is 160° F., the range of acceptable temperatures is 155° F. to 165° F. If temperature of the passageway is below the temperature range or above the temperature range, the lighted displays message "SLOT TEMP LOW" or "SLOT TEMP HIGH" respectively. If the passageway temperature persist below or above the temperature range for an alarm time whose default value is two minute, the audible alarm sounds. To turn off the audible alarm the operator presses any timer key on the display panel above the passageway. The displays will alternatively display the product selection and the alarm message until the passageway temperature returns to the preset holding temperature limits.

An FDA alarm notifies the operator that the passageway temperature is below the preset limit of 140° F. to hold the product. When the FDA alarm condition occurs for an FDA time whose default value is two minutes, the lighted displays messages "TEMP UNDR FDA", and the audible alarm sounds. In addition, all active timers are automatically reset. To turn off the audible alarm, the operator presses one of the timer keys on the display panel. The FDA alarm message remains illustrated until the passageway temperature returns to the preset holding temperature limits. If a timer keys is not pressed, the audible alarm and the FDA message remain.

A sensor fail alarm indicates a faulty sensor. The alarm occurs when the RTD sensor temperature reading is above 260° F. or below 55° F. When one of these conditions occurs, the audible alarm sounds and the lighted displays message "SENS ALRM". To turn off the alarm, the operator presses any timer key on the display panel. The sensor alarm message remains illustrated until the temperature read by the RTD sensors returns to operating limits. The microprocessor removes power to the passageway's heater plates until the sensor is repaired.

A rise time alarm indicates that the passageway temperature failed to reach operating temperature within the preset time limits of the system at power up. If the temperature in the passageway does not increase from 100° F. to 125° F. within fifteen minutes, the lighted displays illustrate "SLOT RISE RATE" and the audible alarm sounds. To clear the display, the operator presses any timer key on the display panel acknowledging the alarm. The rise time alarm notifies the operator that the cabinet requires a service call. The operator may view the results of the rise time test. The rise time test is more fully describe in conjunction with the power up operation of the cabinet control program in FIGS. 6*a* and 6*b*. To view the rise time in minutes, the operator presses the temperature/enter/page key to scroll to the "TEST PAGE" message. The operator then presses the menu key to scroll the rise time recorded for each slot "RISE TIME 9".

The cabinet control program provides a manager mode for modifying preset cabinet operations. In the manager mode, the operator may add, delete and edit product selection messages, change product holding times and temperature settings, adjust display intensity level, set timer display time and product display time values. These functions are password protected, so the operator, preferably the manager of the fast food kitchen, must enter a password before the changes can be made. To enter the manager mode, the operator presses and holds the menu key for five seconds to illustrate the "PROG MODE" message on the lighted displays. The operator further presses the temperature/enter/page key to scroll to the "VIEW PAGE" message. At the "VIEW PAGE" message, the operator presses the menu key to scroll to the "SECR LOCK" message. The operator then uses the up/down arrows to enter the appropriate four digit password number.

In the manager mode, the operator may enter a new product selection. To enter a new product selection, the operator presses the temperature/enter/page key to scroll to the "EDIT PAGE" message on the lighted displays. At the "EDIT PAGE" message, the operator presses the menu key to scroll to a blank or unused product message or to a previous entry for editing. The operator presses the down arrow key to select each displayed character to edit. A flashing decimal point indicates that the selected character is immediately left of the decimal point. Pressing the up arrow key scrolls through the available character choices (A–Z and 0–9) for the displayed character. For example when the lighted displays illustrate "PROD NAME XW.", the operator has selected the second displayed character W. Pressing the up arrow changes the lighted displays to message "PROD NAME XX.". The displayed characters are saved when the program mode is exited.

After the product name is entered, the operator presses the temperature/enter/page key to scroll to the "TIME PAGE" message. The operator presses the menu key to scroll through the product times on the lighted displays, for example "XX TIME 20". To change the time amounts illustrated, the operator presses the up/down arrow keys. To accept a displayed time amount, the operator presses the temperature/enter/page key to move to the "TEMP PAGE" message on the lighted displays. The operator scrolls to the top plate temperature selection with the menu key and presses the up/down keys to change the temperature settings, for example "XX Ttop 155". Pressing the menu key accepts the illustrated top plate temperature and scrolls to the bottom plate temperature which is set following the same procedure as for the top plate temperature.

After the operator has entered the temperature selections, the operator presses the temperature/enter/page key to scroll to the "MEAL PAGE" message. At the "MEAL PAGE" message, the operator presses the menu key to scroll to the meal selection. The operator uses the up/down arrow select breakfast, lunch or all, for example "XX MEAL BFST". An optional feature allows the cook time to be entered by pressing the temperature/enter/page key to scroll to the "COOK PAGE" message. At the "COOK PAGE" message, the operator presses the menu key to scroll to the time cook selections where the up/down arrows change the displayed time amounts.

The operator in the manager mode may change the display intensity level for the product selection by pressing the temperature/enter/page key to scroll to the "VIEW PAGE" message. At the view page, the operator presses the menu key to scroll to the "DIST INT 1" message. By pressing the up/down arrows, the operator scrolls through the intensity level 1, 2 or 3, increasing the number increases the intensity of the display. The operator may also change the display setting time. The display setting time determines the length of time that the holding time and product selection of an active timer are displayed. To change the holding time and the product selection display setting time, the operator presses the temperature/enter/page key to scroll to the "VIEW PAGE" message. The operator then presses the menu key to scroll to the "TIMR TIME" or "PROD TIME" message. By pressing the up/down arrow key the operator changes the default settings which are 5 seconds for the holding time and 1 second for the product selection. All selections in the manager mode are entered by exiting the program mode and returning to the prior illustrated product selections. To exit the program mode, the operator holds the menu key for five seconds. If no key entries occur for five minutes in the program mode, the master microprocessor exits the program mode returning to the prior illustrated product selections.

The cabinet control program further provides a service mode. In the service mode, the operator, preferably a field service technician, has access to menu selections necessary for servicing the holding cabinet. The selections accessible by the field service technician include inputs, outputs, calibration parameters, alarm set points, enable/disable alarm conditions, FDA temperature alarm and °F. to °C. conversion. Another mode provided by the cabinet control program is the factory mode which allows access to several factory-determined test modes. The test modes include sequencing the outputs in ten second increments for automatic testing, holding temperature set points at 140° F. for entry of calibration offset data, and ramping holding temperatures to 200° F. for verification of offset data. The test mode is more fully described in conjunction with FIGS. 13*a* and 13*b* below. The cabinet control program also has a Chromolox mode which provides access to test and calibration menus. The service, factory and Chromolox modes are password protected requiring the operator to enter the proper password prior to entering those modes.

Figure 6B:
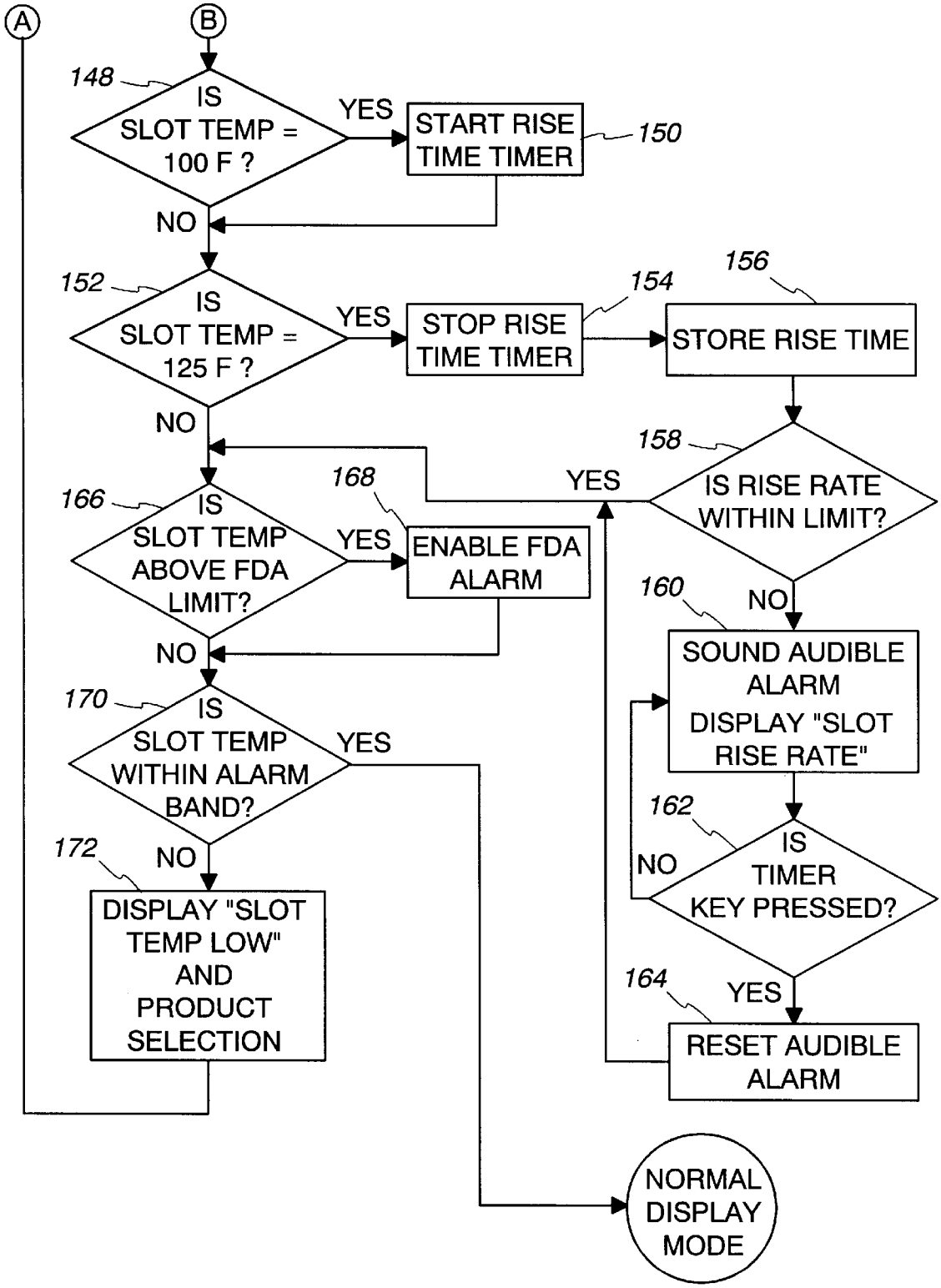

The master microprocessor's cabinet control program consists of a group of routines that control the operations of the holding cabinet 10. When the operator turns on the power to the cabinet, the master microprocessor begins performing the power on routine. FIGS. 6*a* and 6*b* are a flow chart of the power on routine. The flow charts describe the steps of the program routines for a single passageway and corresponding display panel because the master microprocessor follows the same steps for each passageway and corresponding display panel. In the power on routine, the master microprocessor supplies power to the heater plates, monitors for operator input and determines whether the rise time is within preset limits.

The power on routine begins when the power is supplied to the cabinet. At step 132, the master microprocessor displays the version number of the cabinet on the lighted displays of each display panel 26 and 28 for five seconds. At step 134, the master microprocessor determines whether the temperature of the passageway is above the FDA limit of 140° F. If the answer at step 134 is affirmative for all of the passageways, the master microprocessor lost power momentarily, so the master microprocessor initializes the product selection illustrated on the lighted displays with the previous selections at step 136. The master microprocessor also clears the temperature and FDA alarm inhibits so the alarms will sound if any an alarm condition occurs. If the answer at step 134 was negative, the cabinet did not momentarily lose power, so the master microprocessor initializes the product selections illustrated on the lighted displays to the default breakfast settings at step 138. The master microprocessor also inhibits the FDA and low alarms to prevent the alarms from sounding when the cabinet is just turned on. At step 140, the master microprocessor enables the temperature control to supply power to the heater plates to provide heat within the passageway. The master microprocessor then monitors for any operator key presses.

At step 142, the master microprocessor determines whether the operator press the temperature/enter/page key. If the answer at step 142 is affirmative, the master microprocessor passes control to the temperature display mode which will be described in conjunction with FIGS. 11*a* and 11*b*. If the answer at step 142 is negative, the master microprocessor determines whether the operator pressed the menu key at step 144. If the answer at step 144 is affirmative, the master microprocessor proceeds to the menu display mode which will be described in conjunction with FIGS. 8*a*, 8*b* and 8*c*. If the answer at step 144 is negative, the master microprocessor determines whether the operator selected the program mode at step 146. To select the program mode, the operator holds down the menu key for five seconds. If the answer at step 146 is affirmative, the master microprocessor goes to the program mode which will be described in conjunction with FIGS. 10*a* and 10*b*. If the answer at step 146 is negative, the master microprocessor goes to step 147. At step 147, the master microprocessor executes the Check for UHC Test Mode routine which is described in detail in conjunction with FIGS. 13*a* and 13*b*.

After returning from the Check for UHC Test Mode routine, the master microprocessor determines whether the passageway temperature is 100° F. at step 148. If the answer at step 148 is affirmative, the master microprocessor starts a rise time timer at step 150 and continues to step 152. If the answer at step 148 is negative, the master microprocessor determines whether the passageway temperature is 125° F. at step 152. If the answer at step 152 is affirmative, the master microprocessor stops the rise time timer at step 154 and stores the rise time in memory at step 156. At step 158 the master microprocessor determines whether the rise time is within the 15 minute factory limit. If the answer at step 158 is negative, the master microprocessor sounds an audible alarm and displays a "SLOT RISE RATE" message on the lighted displays of the display panel at step 160. At step 162 the master microprocessor determines whether the operator pressed one of the timer keys on the display panel to acknowledge the rise time alarm and to acknowledge the need for a service call for the holding cabinet. If the answer at step 162 is negative, the master microprocessor returns to step 160. If the answer at step 162 is affirmative, the master microprocessor turns off the audible alarm and proceeds to step 166. If the answer at step 158 is affirmative, the master microprocessor also proceeds to step 166. Likewise, if the answer at step 152 is negative, the master microprocessor proceeds to step 166.

At step 166 the master microprocessor determines whether the passageway temperature is above the FDA limit of 140° F. If the answer at step 166 is affirmative, the master microprocessor enables the FDA alarms at step 168 before proceeding the step 170. When the FDA alarm is enabled, the FDA alarm will sound if the passageway temperature falls below 140° F. If the answer at step 166 is negative, the master microprocessor continues to step 170 to determine whether the passageway temperature is within its alarm band. The alarm band is the predetermined range of holding temperature for the product selection in the left tray location of the passageway. If the answer at step 170 is negative, the master microprocessor alternates "SLOT TEMP LOW" and the product selection at the highest intensity level on the lighted display of the display panel at step 172 before returning to step 142. If the answer at step 170 is affirmative, the master microprocessor proceeds to the normal display mode routine.

Figures 7, 7A, 7B:
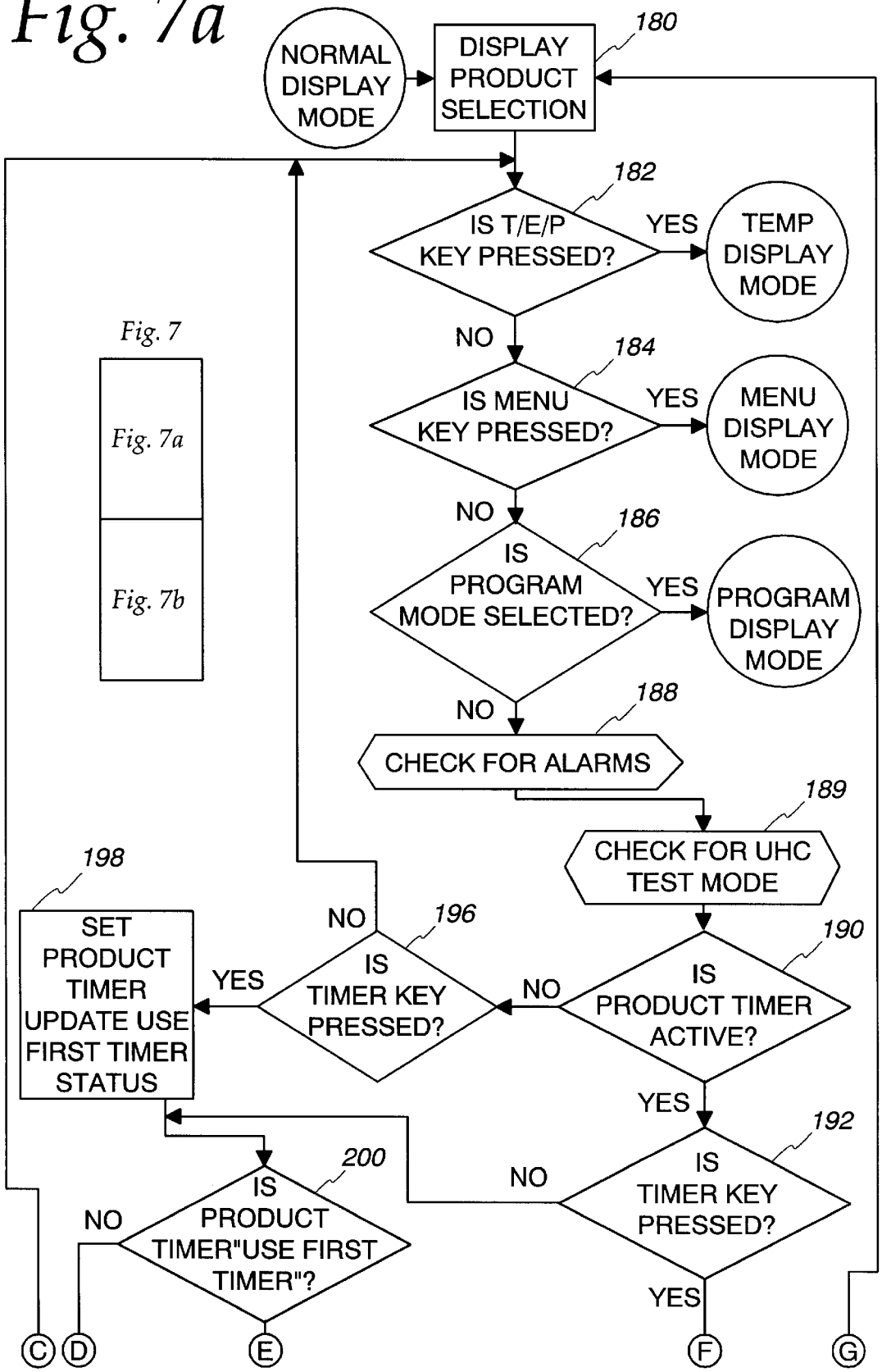
FIGS. 7*a* and 7*b* are a flow chart of the normal display mode routine used by the control system.
Figure 7B:
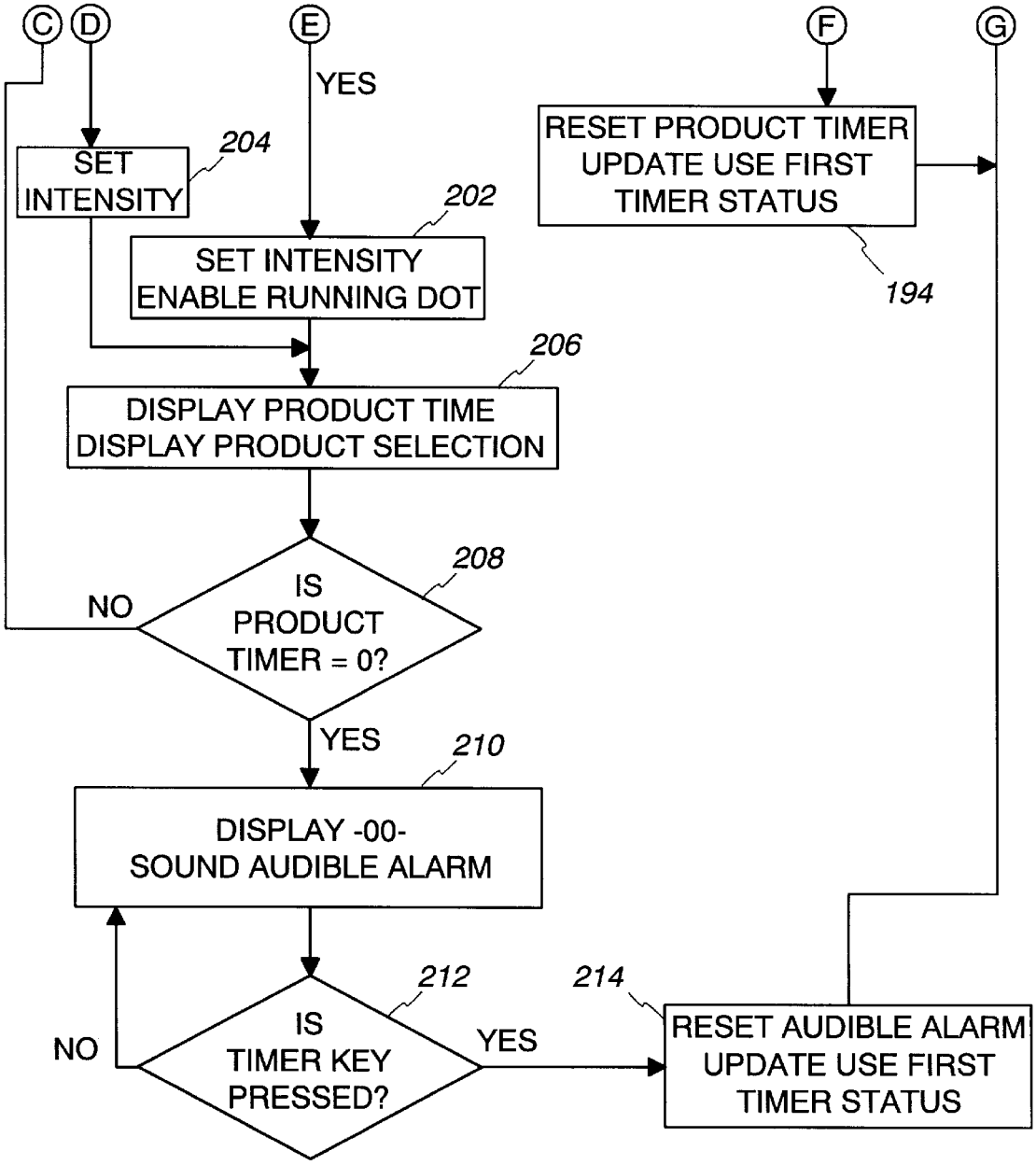

FIGS. 7*a* and 7*b* are a flow chart of the normal display mode routine. In the normal display mode, the master controller illustrates the product selection on the lighted displays, monitors for operator input and controls product timers. At step 180 the master microprocessor displays the product selections on the lighted displays of the display panel at the low intensity level. At step 182 the master microprocessor determines whether the operator pressed the temperature/enter/page key. If the answer at step 182 is affirmative, the master microprocessor passes control to the temperature display mode which will be described in conjunction with FIGS. 1*a* and 1*b*. If the answer at step 182 is negative, the master microprocessor determines whether the operator pressed the menu key at step 184. If the answer at step 184 is affirmative, the master microprocessor proceeds to the menu display mode which will be described in conjunction with FIGS. 8*a*, 8*b* and 8*c*. If the answer at step 184 is negative, the master microprocessor determines whether the operator selected the program mode at step 186. If the answer at step 186 is affirmative, the master microprocessor goes to the program mode as described in conjunction with FIGS. 10*a* and 10*b*.

Figure 9B:
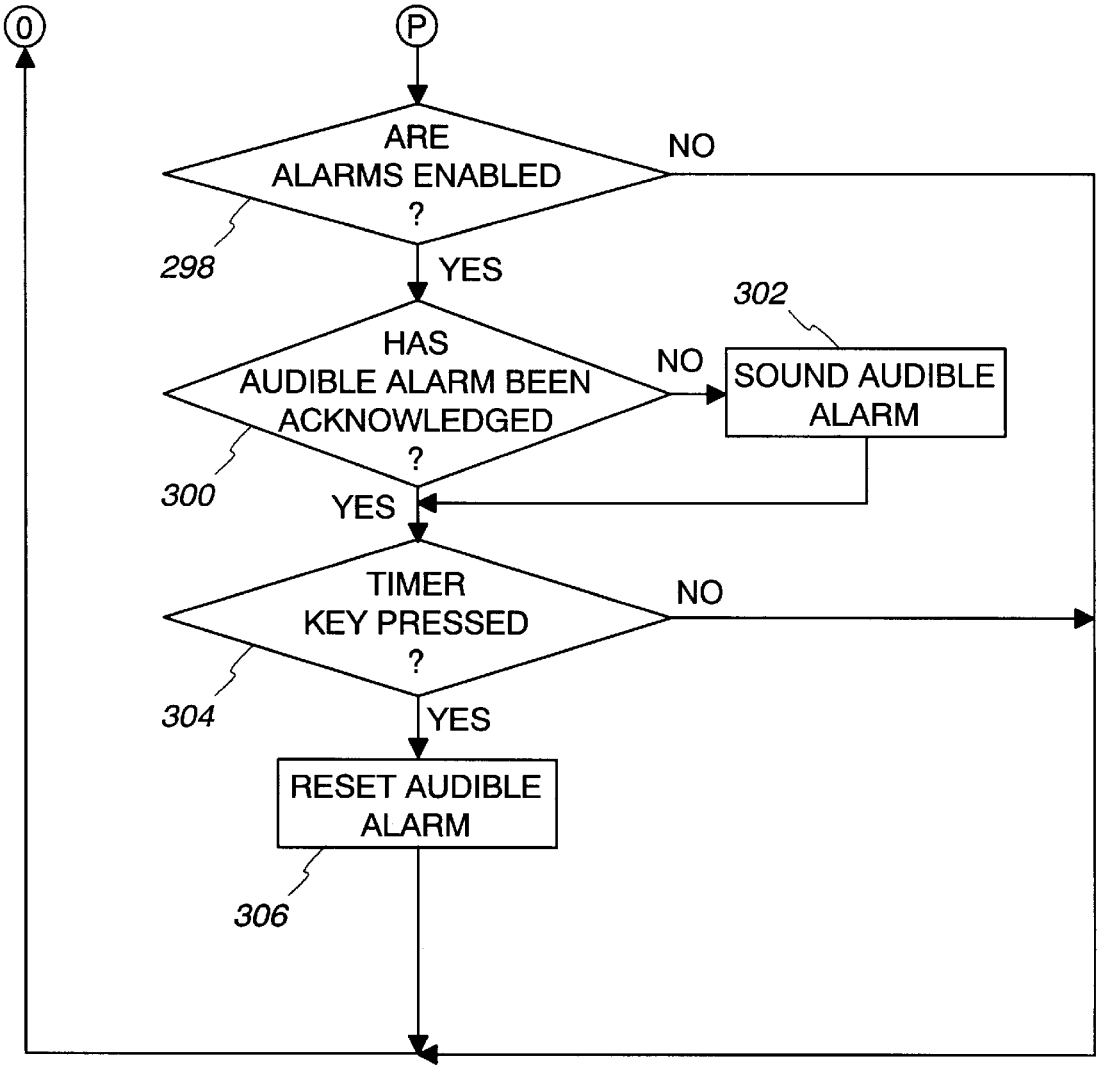
FIGS. 9*a* and 9*b* are a flow chart of the check for alarms routine used by the control system.
Figure 9:
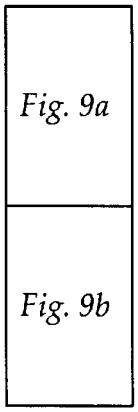

If the answer is at step 186 is negative, the master microprocessor executes the check for alarms routine which is described in detail in conjunction with FIGS. 9*a* and 9*b* at step 188. At step 189, the master microprocessor executes the check for UHC test mode routine which is described in detail in conjunction with FIGS. 13*a* and 13*b*. At step 190, the master microprocessor determines whether a product timer is active. When a product timer is active, the product timer is counting down from the preset holding time. If the answer at step 190 is affirmative, the master microprocessor determines whether the operator pressed the product timer's corresponding timer key at step 192. If the answer at step 192 is affirmative, the master microprocessor resets the product timer and updates the use first timer status at step 194 before returning to step 180.

If the answer at step 190 is negative, the master microprocessor determines whether the operator pressed the timer key at step 196. If the answer at step 196 is negative, the master microprocessor returns to step 182. If the answer at step 196 is affirmative, the master microprocessor sets the product timer to begin count down from the predetermined holding time and updates the use first timer status at step 198 before proceeding to step 200. If the answer at step 192 was negative, the master microprocessor moves to step 200. At step 200 the master microprocessor determines whether the product timer is a use first timer. If the answer at step 200 is affirmative, the master microprocessor sets the corresponding lighted display to the highest intensity and illustrates running dots on the lighted display at step 202 before proceeding to step 206. If the answer at step 200 is negative, the master microprocessor sets the display to medium intensity level two and proceeds to step 206. At step 206, the master microprocessor alternates the product time or holding time remaining on the product timer and the product selection on the lighted display. At step 208, the master microprocessor determines whether the product timer has expired by decreasing to zero. If the answer at step 208 is negative, the master microprocessor returns to step 182. If the answer at step 208 is affirmative, the master microprocessor displays "00" at intensity level three, sets all other active product timers to intensity level one and sounds an audible alarm at step 210. At step 212 the master microprocessor determines whether the operator pressed the timer key corresponding to the time out alarm. If the answer at step 212 is negative, the master microprocessor returns to step 210. If the answer at step 212 is affirmative, the master microprocessor resets the audible alarm, updates the use first timer status and resets active timers display status at step 214 before returning to step 180.

Figure 8B:
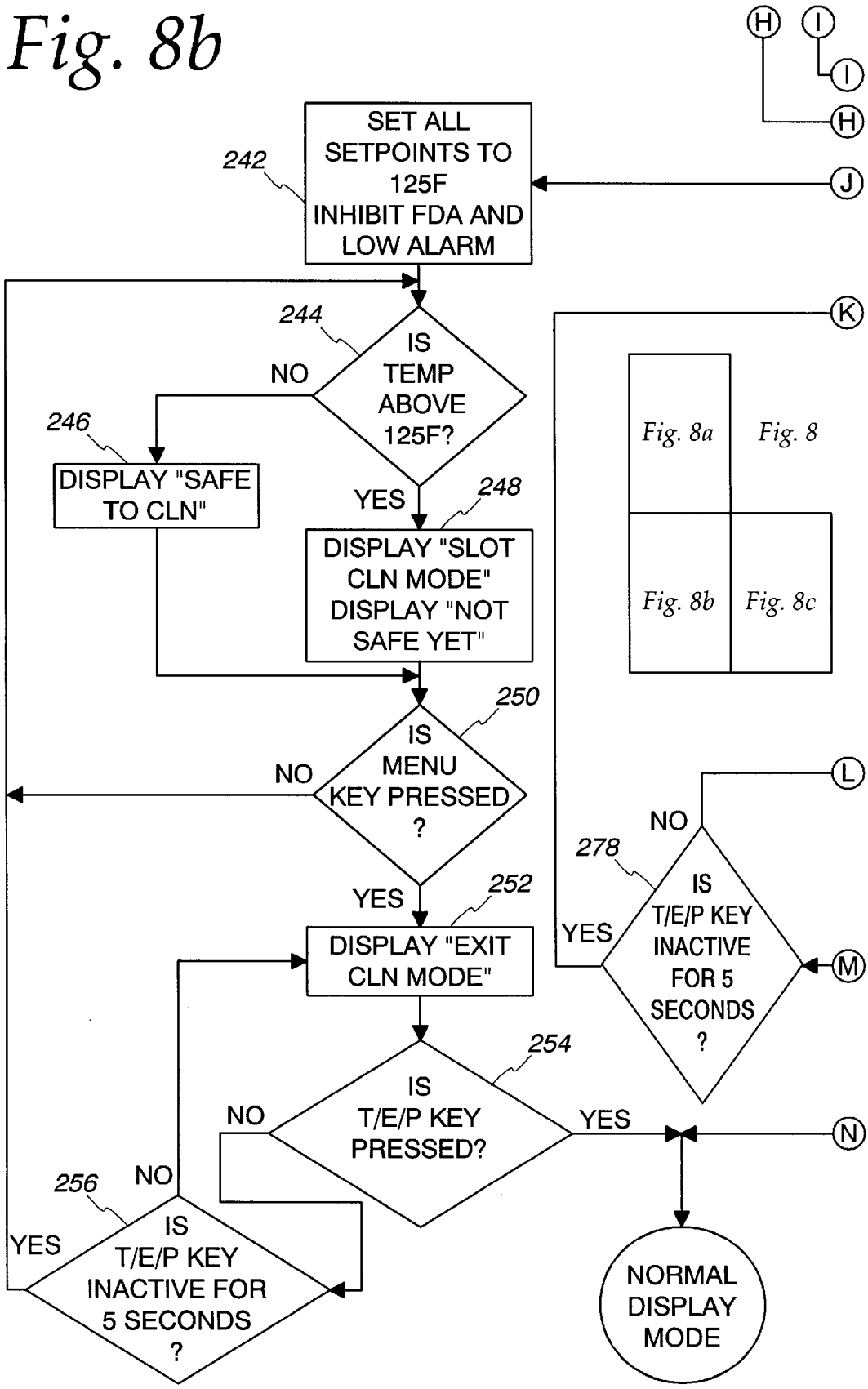
Figure 8C:
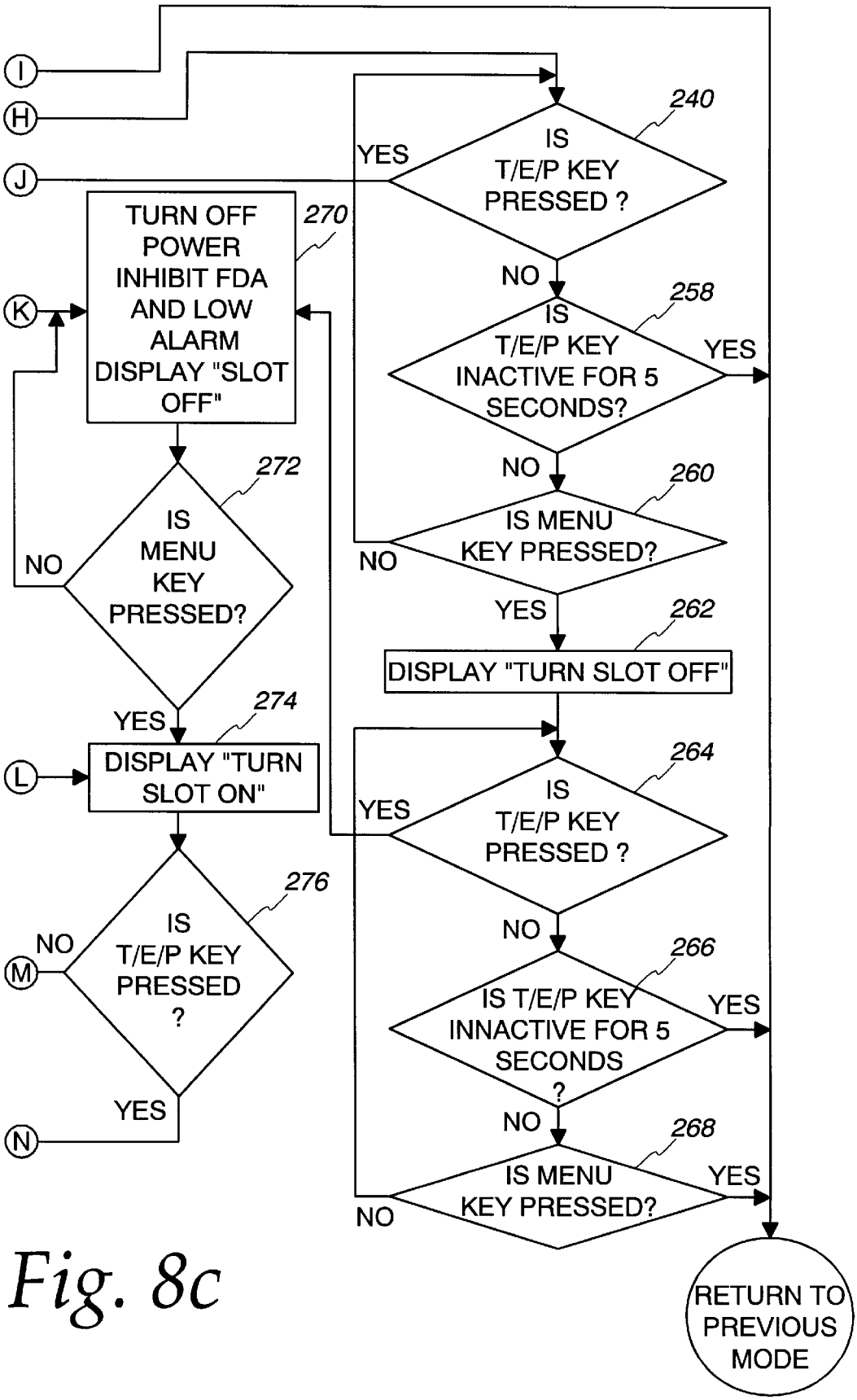

FIGS. 8*a*, 8*b* and 8*c* is a flow chart of the menu display mode. In the menu display mode, the master microprocessor allows the operator to change meal selections, to enter the clean mode, and to turn a passageway on or off. At step 216 the master microprocessor illustrates the inactive meal selections on the lighted displays at the highest intensity level three. At step 218 the master microprocessor determines whether the operator pressed the temperature/enter/page key to enter the meal selection illustrated on the lighted displays. If the answer at step 218 is negative, the master microprocessor determines whether the temperature/enter/page key and the menu key have been inactive for five seconds at step 220. If the answer at step 220 is affirmative, the master microprocessor returns to the previous mode. If the answer at step 220 is negative, the master microprocessor determines whether the menu key has been pressed at step 222. If the answer at step 222 is affirmative, the master microprocessor illustrates the "CLN MODE" message at the highest intensity level three on the lighted displays at step 224 before continuing to step 240. If the answer at step 222 is negative, the master microprocessor returns to step 218.

If the answer to step 218 is affirmative, the master microprocessor determines whether any passageway timers are active at step 226. If the answer at step 226 is negative, the master microprocessor illustrates the new meal product selections on the lighted displays and updates the passageway temperature setpoint to correspond to the new meal product selections at step 228 before returning to the previous mode. If the answer at step 226 is affirmative, the master microprocessor determines whether the passageway temperature set points of the previous product selections are identical to the passageway temperature set points of the new meal product selections at step 230. If the answer at step 230 is affirmative, the master microprocessor waits until any active timers expire and the operator acknowledges the expired timers by pressing the corresponding timer key before illustrating the new meal product selections on the corresponding lighted displays at step 232. If the answer at step 230 was negative, the master microprocessor determines whether the left timer is active at step 234. If the answer at step 234 is affirmative, the master microprocessor waits until the left timer expires and the operator acknowledges the expired timer by pressing the left timer key before updating the passageway temperature setpoint to correspond to the left new product meal selection at step 236. At step 236, the master microprocessor also waits until the active timers for the center and right positions to expire and the operator to acknowledge the expired timers before illustrating the new meal product selections on the corresponding center and right lighted displays before returning to the previous mode. If the answer to step 234 is negative, the master microprocessor changes passageway temperature set point to the left new meal product selection at step 238. The master microprocessor also waits until any active timers for the center and right positions to expire and the operator to acknowledge the expired timers before illustrating the new meal product selections on the corresponding center and right lighted displays at step 238 before returning to the previous mode.

At step 240 the master microprocessor determines whether the temperature/enter/page key has been pressed to enter the clean mode. If the answer at step 240 is affirmative, the master microprocessor sets all the temperature set points of all the passageways to 125° F. at step 242. To prevent the FDA and low temperature alarm from sounding, the master microprocessor inhibits the FDA and low temperature alarms for all of the passageways at step 242. At step 244 the master microprocessor determines whether the passageway temperature is above 125° F. If the answer at step 244 is negative, the master microprocessor illustrates "SAFE TO CLN" on the lighted displays at the highest intensity level three at step 246 before proceeding to step 250. If the answer at step 244 is affirmative, the master microprocessor illustrates "SLOT CLN MODE" on the lighted displays at the highest intensity level three for five seconds before messaging "NOT SAFE YET" at the highest intensity level three for one second.

At step 250 the master microprocessor determines whether the menu key has been pressed. If the answer at step 250 is negative, the master microprocessor returns to step 244. If the answer at step 250 is affirmative, the master microprocessor messages "EXIT CLN MODE" on the lighted displays at the highest intensity level three at step 252. At step 254, the master microprocessor determines whether the temperature/enter/page key has been pressed to accept the "EXIT CLN MODE" message and exit the clean mode. If the answer at step 254 is affirmative, the master microprocessor returns to the normal display mode using the default breakfast product selections for illustration on the lighted displays and for updating the passageway setpoints. If the answer at step 254 is negative, the master microprocessor determines whether the temperature/enter/page key has been inactive for five seconds at step 256. If the answer at step 256 is negative, the master microprocessor returns to step 252. If the answer at step 256 is affirmative, the master microprocessor returns to step 244.

If the answer at step 240 is negative, the master microprocessor determines whether the temperature/enter/page key has been inactive for five seconds at step 258. If the answer at step 258 is affirmative, the master microprocessor returns to the previous mode. If the answer at step 258 is negative, the master microprocessor determines whether the menu key has been pressed at step 260. If the answer at step 260 is negative, the master microprocessor returns to step 240. If the answer at step 260 is affirmative, the master microprocessor illustrates "TURN SLOT OFF" on the lighted displays at the highest intensity level three at step 262 before proceeding to step 264. At step 264, the master microprocessor determines whether the temperature/enter/page key has pressed to accept the "TURN SLOT OFF" message. If the answer at step 264 is negative, the master microprocessor determines whether the temperature/enter/page key has been inactive for five seconds at step 266. If the answer at step 266 is affirmative, the master microprocessor returns to the previous mode. If the answer at step 266 is negative, the master microprocessor determines whether the menu key has been pressed at step 268. If the answer at step 268 is affirmative, the master microprocessor returns to the previous mode. If the answer at step 268 is negative, the master microprocessor returns to step 264.

If the answer at step 264 was affirmative, the master microprocessor turns off the power to the heater plates for the passageway displaying the "TURN SLOT OFF" message at step 270 The master microprocessor also inhibits the FDA and low alarms to prevent those alarms from sounding and displays "SLOT OFF" on the lighted displays at the highest intensity level three at step 270. At step 272, the master microprocessor determines whether the menu key has been pressed. If the answer is negative, the master microprocessor returns to step 270. If the answer to step 272 is affirmative, the master microprocessor illustrates "TURN SLOT ON" on the lighted displays at the highest intensity level three at step 274. At step 276, the master microprocessor determines whether the temperature/enter/page key has pressed to accept the "TURN SLOT ON" message. If the answer at step 276 is affirmative, the master microprocessor returns to the normal display mode using the default breakfast product selections for illustration on the lighted displays and for updating the passageway setpoints. If the answer at step 276 is negative, the master microprocessor determines whether the temperature/enter/page key has been inactive for five seconds at step 278. If the answer at step 278 is negative, the master microprocessor returns to step 274. If the answer at step 278 is affirmative, the master microprocessor returns to step 270.

FIGS. 9*a* and 9*b* are a flow chart of the check for alarms routine. In the alarm display mode, the master microprocessor determines which temperature alarm is active and illustrates the appropriate messages on the lighted displays. At step 280 the master microprocessor determines whether the passageway temperature is above or below the sensor span of 55° F. to 260° F. If the answer to step 280 is affirmative, the master microprocessor alternates between illustrating "SENS ALRM" on the lighted displays at highest intensity level three for five seconds, and illustrating the product selection at the highest intensity level three for one second at step 282 before proceeding to step 298. At step 284, the master microprocessor determines whether the passageway temperature is above the high temperature limit. If the answer at step 284 is affirmative, the master microprocessor alternates between illustrating "SLOT TEMP HIGH" on the lighted displays at highest intensity level three for five seconds, and illustrating the product selection at the highest intensity level three for one second at step 286 before proceeding to step 296. If the answer at step 284 is negative, the master microprocessor determines whether the passageway temperature is below the low temperature limit at step 288. If the answer at step 288 if negative, the master microprocessor goes to the normal display mode.

If the answer at step 288 is affirmative, the master microprocessor determines whether the passageway temperature has been below the FDA temperature limit of 140° F. is for longer than the FDA time limit (default FDA time limit is two minutes) at step 290. If the answer at step 290 is affirmative, the master microprocessor alternates between illustrating "SLOT UNDR FDA" on the lighted displays at highest intensity level three for five seconds, and illustrating the product selection at the highest intensity level three for one second at step 292 before proceeding to step 298. If the answer to step 290 is negative, the master microprocessor alternates between illustrating "SLOT TEMP LOW" on the lighted displays at highest intensity level three for five seconds, and illustrating the product selection at the highest intensity level three for one second at step 294 before proceeding to step 296.

At step 296, the master microprocessor determines whether the alarm condition has existed longer than the alarm time limit (default alarm time limit is two minutes). If the answer at step 296 is negative, the master microprocessor returns to step 280. If the answer at step 296 is affirmative, the master microprocessor determines whether the alarms are enabled at step 298. If the answer at step 298 is negative, the master microprocessor returns to step 280. If the answer at step 298 is affirmative, the master microprocessor determines whether the audible alarm has been latched or acknowledged at step 300. If the answer at step 300 is negative, the master microprocessor sounds and latches the audible alarm at step 302 before proceeding to step 304. If the answer at step 300 is affirmative, the master microprocessor determines whether a timer key has been pressed to acknowledge the alarm at step 304. If the answer at step 304 is negative, the master microprocessor returns to step 280. If the answer at step 304 is affirmative, the master microprocessor silences and resets the audible alarm at step 306 before returning to step 280.

Figures 10, 10A:
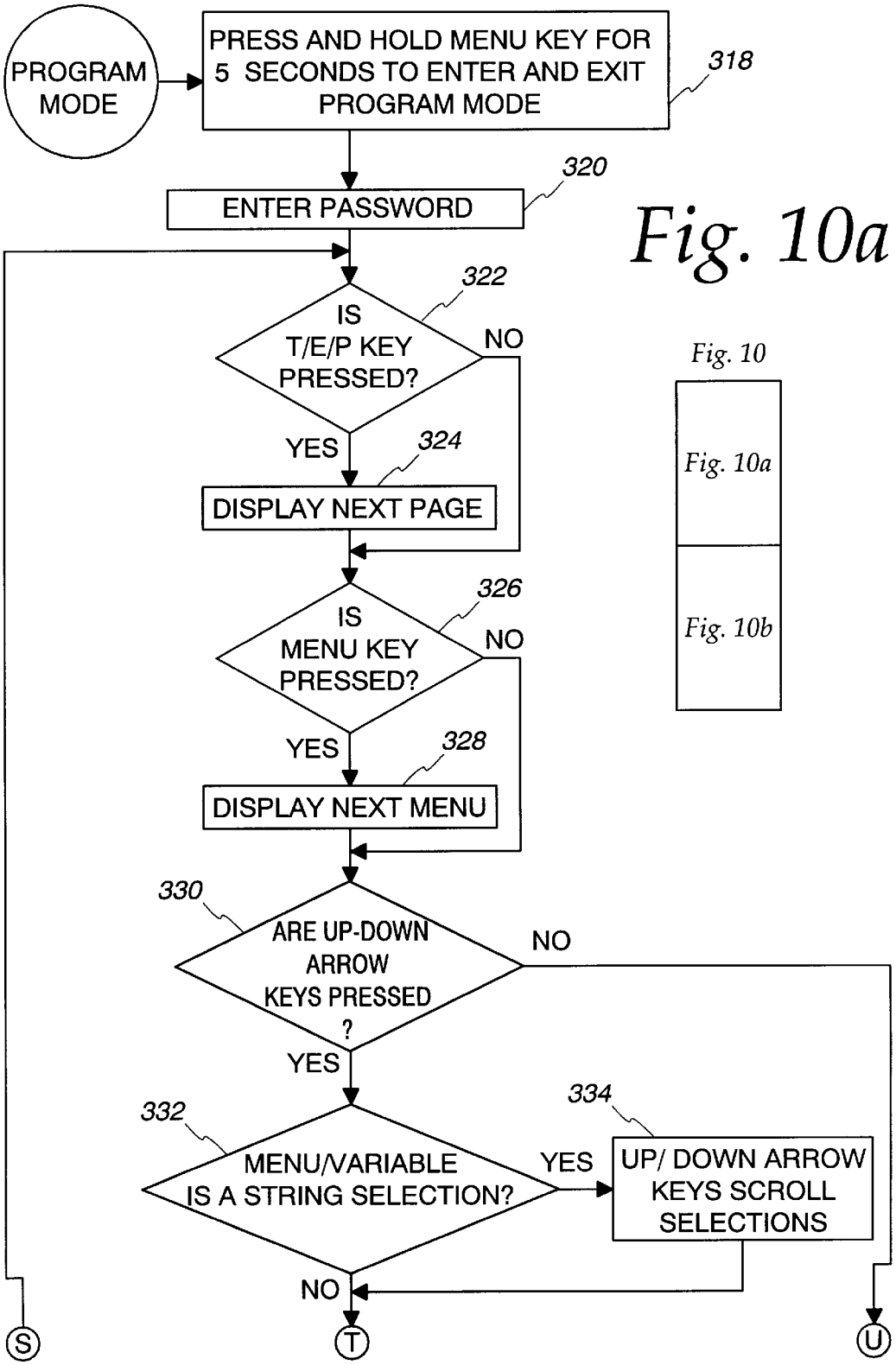
FIGS. 10*a* and 10*b* are a flow chart of the program mode routine used by the control system.
Figure 10B:
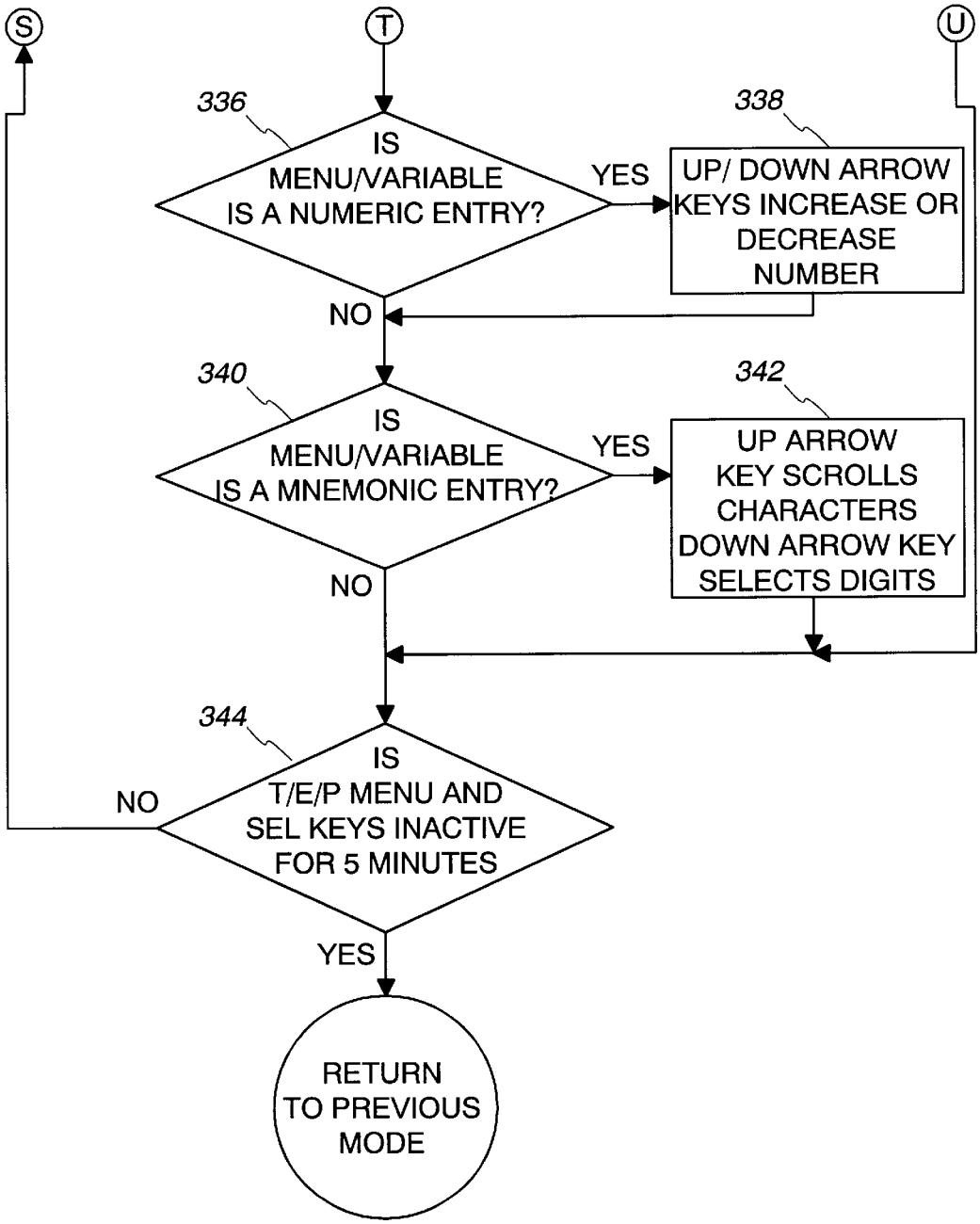

FIGS. 10*a* and 10*b* is a flow chart of the program mode routine. In the program mode, the master microprocessor allows the operator to add, delete, edit product selection mnemonics, change product holding times, change holding temperatures, adjust display intensity levels, set amount of time the product selection and product time are displayed. At step 318 the master microprocessor monitors for the operator to press and hold the menu key for five seconds to enter and to exit the program mode. At step 320 the master microprocessor requires the operator to enter a password. To enter the password, the operator presses the temperature/enter/page key to scroll to the "VIEW PAGE" message. The operator then presses the menu key to scroll to the "SECR LOCK" message. At the "SECR LOCK" message, the operator uses the up/down arrow keys to enter in the proper four digit number. After the operator has entered in the correct password, the master microprocessor determines whether the temperature/enter/page key has been pressed at step 322. If the answer at step 322 is affirmative, the master microprocessor illustrates the next page, for example "SLOT 1 PAGE", "SLOT 2 PAGE", "SLOT 3 PAGE", "SLOT 4 PAGE", on the lighted displays at step 324 prior to proceeding to step 326. If the answer at step 322 is negative, the master microprocessor determines whether the menu key was pressed at step 326. If the answer at step 326 is affirmative, the master microprocessor illustrates the next menu on the lighted displays, for example "BFST LEFT SAUS, BFST CENT SAUS, BFST RGHT SAUS", at step 328 prior to proceeding to step 330.

If the answer at step 326 was negative, the master microprocessor determines whether the up/down selection arrow keys have been pressed at step 330. If the answer at step 330 is affirmative, the master microprocessor determines whether illustrated message on the lighted displays is a string selection, for example "SAUS", "ROUN" or "FISH" at step 332. If the answer at step 332 is affirmative, the master microprocessor scrolls through product selections such as "SAUS", "ROUN" and "FISH", illustrated on the lighted displays when up/down arrow keys are pressed at step 334 prior to proceeding to step 336. If the answer at step 332 was negative, the master microprocessor determines whether the illustrated message on the lighted displays is a numeric selection, for example "2" at step 336. If the answer at step 336 is affirmative, the master microprocessor increases or decreases the illustrated number when the up or down arrow key respectively are pressed at step 338 prior to proceeding to step 340. If the answer at step 336 was negative, the master microprocessor determines whether the illustrated message on the lighted displays is a product mnemonic character at step 340. If the answer at step 340 is affirmative, the master microprocessor scrolls the alpha and number characters for the up arrows and moves the decimal point to indicate digit at step 342 prior to proceeding to step 344. If the answer at step 326 was negative, the master microprocessor determines whether the temperature/enter/page key, menu key and up/down arrow keys have been inactive for five minutes at step 344. If the answer at step 344 is affirmative the master microprocessor returns to the previous mode. If the answer at step 344 is negative, the master microprocessor returns to step 322.

Figure 11A:
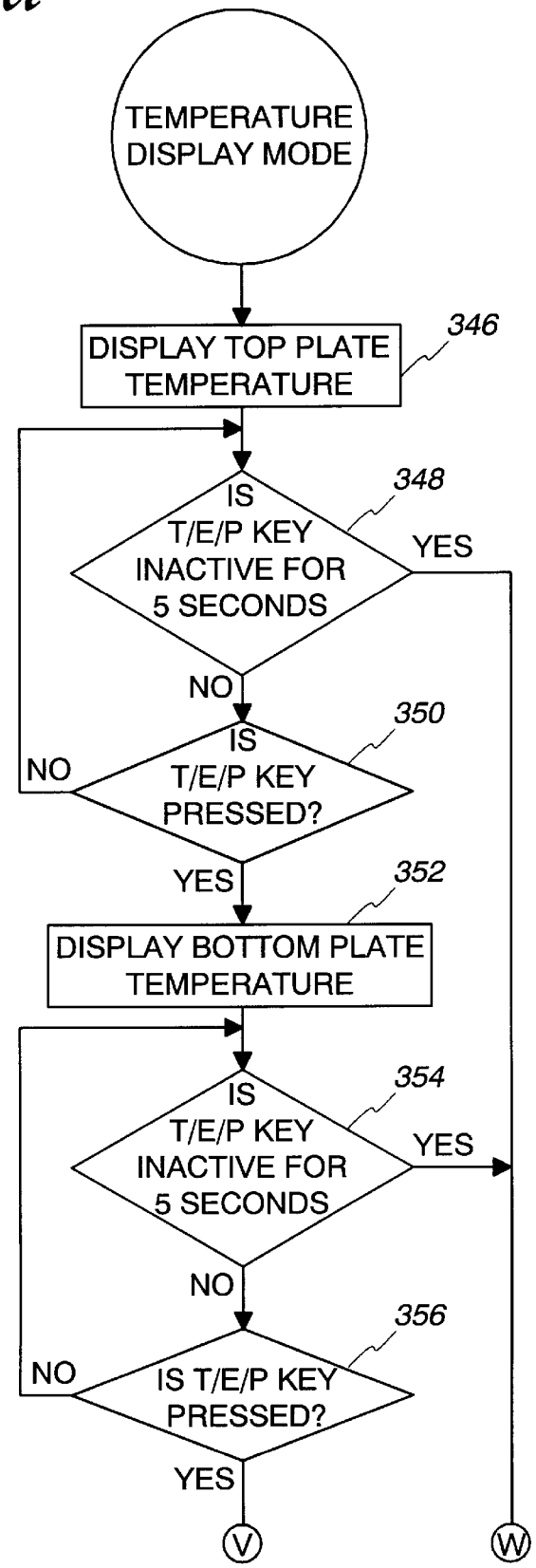
FIGS. 11*a* and 11*b* are a flow chart of the temperature display mode routine used by the control system.
Figure 11A:
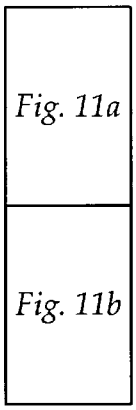
Figure 11B:
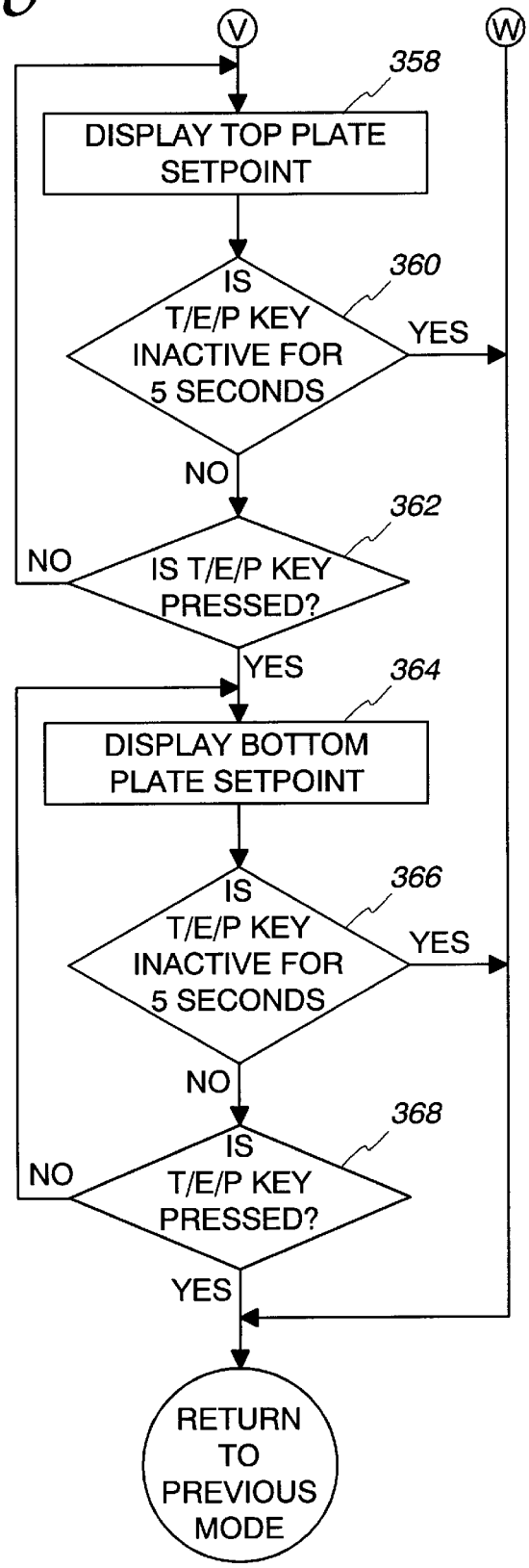

FIGS. 11*a* and 11*b* are a flow chart of the temperature display mode routine. In the temperature display mode, the master microprocessor allows the operator to illustrate the temperature conditions on the lighted displays. At step 346 the master microprocessor illustrates the top plate temperature on the lighted displays, for example "TOP TEMP 160". At step 348 the master microprocessor determines whether the temperature/enter/page key has been inactive for 5 seconds. If the answer at step 348 is affirmative, the master microprocessor returns to the previous mode. If the answer at step 348 is negative, the master microprocessor determines whether the temperature/enter/page key has been pressed at step 350. If the answer at step 350 is affirmative, the master microprocessor illustrates the bottom plate temperature on the lighted displays at step 352, for example "BOT TEMP 160". If the answer at step 350 is negative, the master microprocessor returns to step 348.

At step 354 the master microprocessor determines whether the temperature/enter/page key has been inactive for 5 seconds. If the answer at step 354 is affirmative, the master microprocessor returns to the previous mode. If the answer at step 354 is negative, the master microprocessor determines whether the temperature/enter/page key has been pressed at step 356. If the answer at step 356 is affirmative, the master microprocessor illustrates the top heater plate set point on the lighted displays at step 358, for example "TOP TSET 160". If the answer at step 356 is negative, the master microprocessor returns to step 354. At step 360 the master microprocessor determines whether the temperature/enter/page key has been inactive for 5 seconds. If the answer at step 360 is affirmative, the master microprocessor returns to the previous mode. If the answer at step 360 is negative, the master microprocessor determines whether the temperature/enter/page key has been pressed at step 362. If the answer at step 362 is affirmative, the master microprocessor illustrates the bottom heater plate set point on the lighted displays at step 364, for example "BOT TSET 160". If the answer at step 362 is negative, the master microprocessor returns to step 358. At step 366 the master microprocessor determines whether the temperature/enter/page key has been inactive for 5 seconds. If the answer at step 366 is affirmative, the master microprocessor returns to the previous mode. If the answer at step 366 is negative, the master microprocessor determines whether the temperature/enter/page key has been pressed at step 368. If the answer at step 368 is affirmative, the master microprocessor returns to the previous mode. If the answer at step 368 is negative, the master microprocessor returns to step 364.

Figures 12, 12A, 12B:
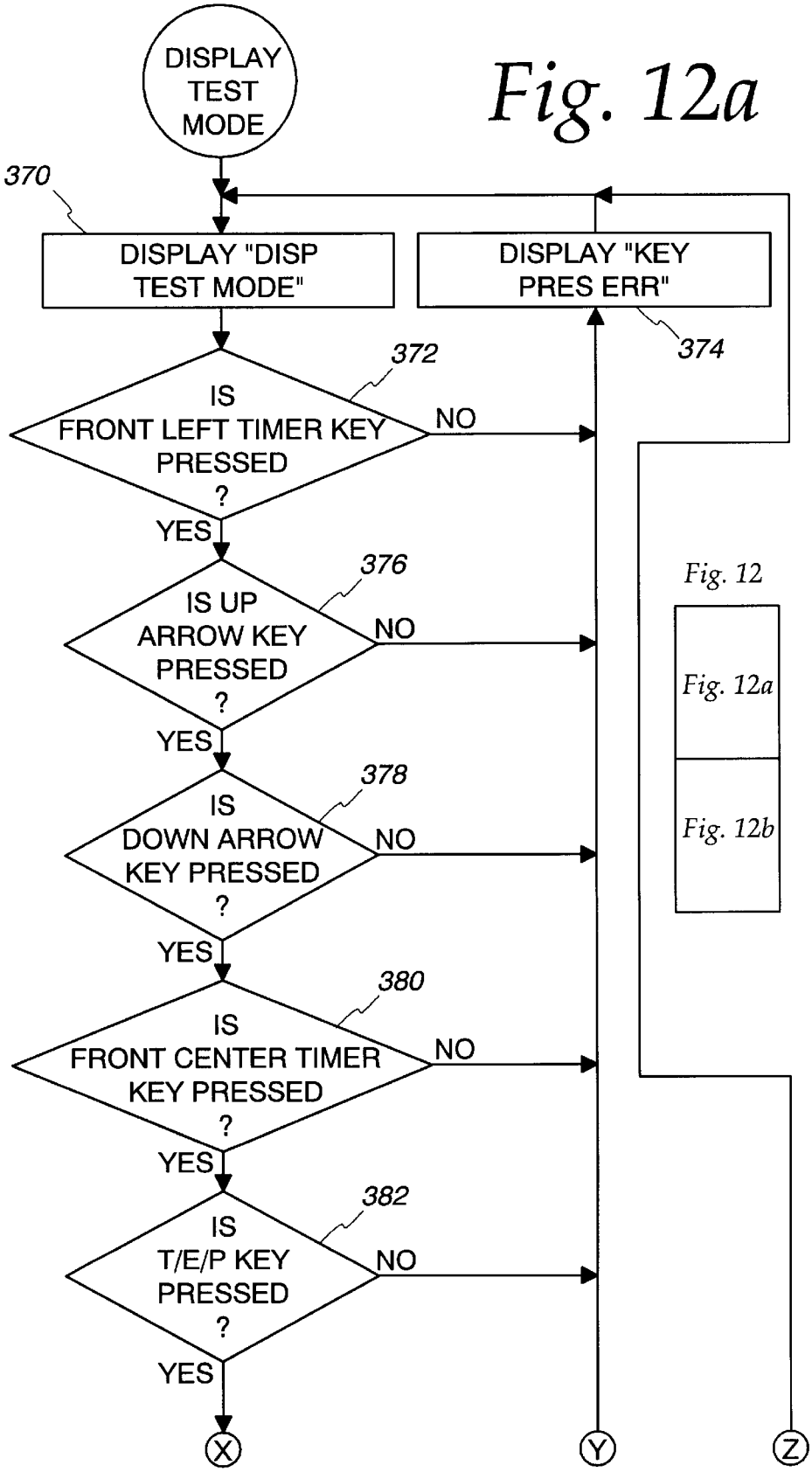
FIGS. 12*a* and 12*b* are a flow chart of the display test mode routine used by the control system.
Figure 12B:
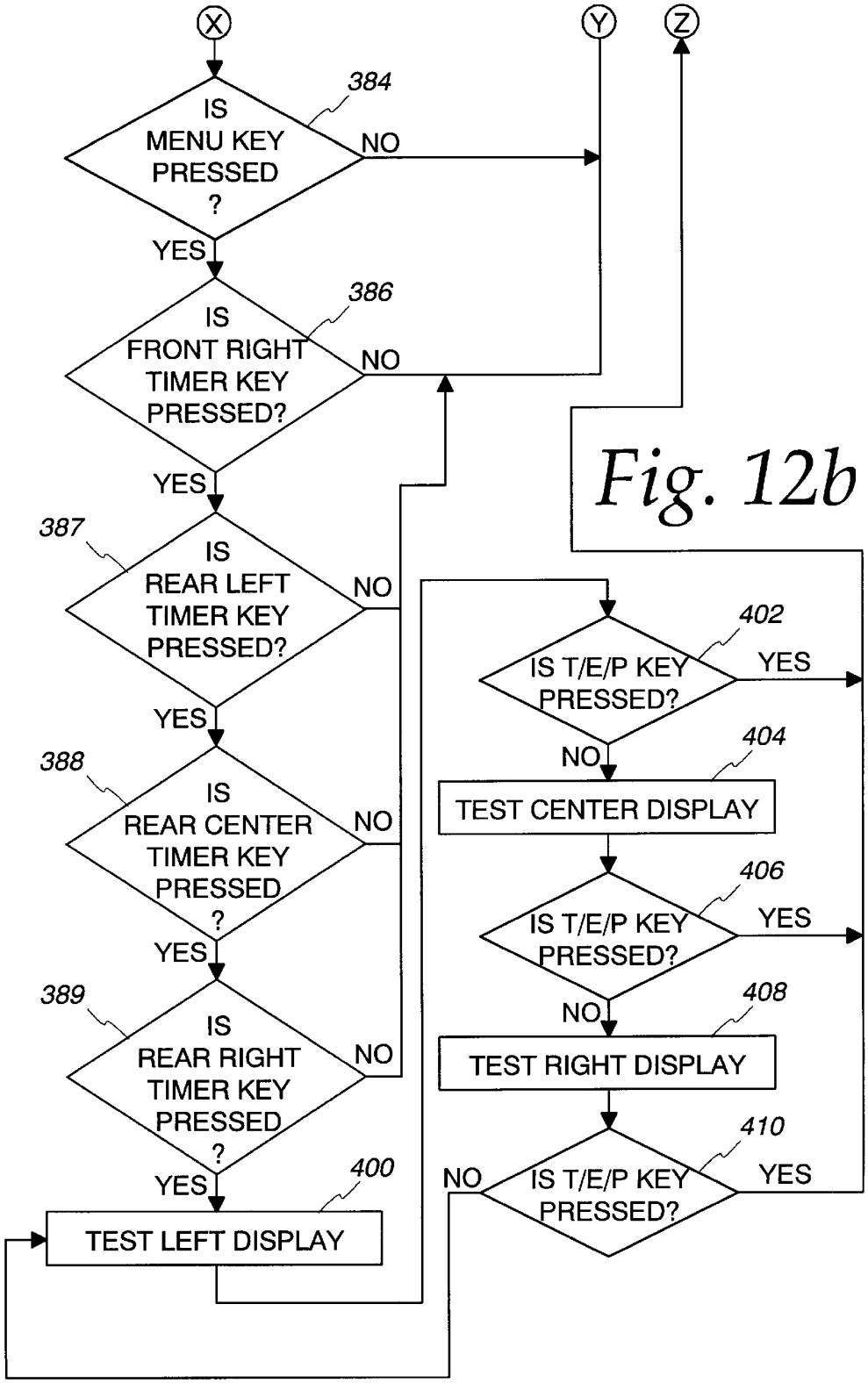

FIGS. 12*a* and 12*b* are a flow chart of the display test mode. In the display test mode, the master microprocessor monitors the operator pressing the keys on the display panels to test cabinet. At step 370 the master microprocessor illustrates "DISP TEST MODE" on the lighted displays. At step 372, the master microprocessor determines whether the front panel left timer key has been pressed. If the answer at step 372 is negative, the master microprocessor messages "KEY PRES ERR" on the lighted displays for three seconds at step 374 before returning to step 370. If the answer at step 372 is affirmative, the master microprocessor determines whether the front panel up arrow key has been pressed at step 376. If the answer at step 376 is negative, the control goes to step 374. If the answer at step 382 is affirmative, the master microprocessor determines whether the front panel down arrow key has been pressed at step 378. If the answer at step 378 is negative, the control goes to step 374.

If the answer at step 378 is affirmative, the master microprocessor determines whether the front panel center timer key has been pressed at step 380. If the answer at step 380 is negative, the control goes to step 374. If the answer at step 380 is affirmative, the master microprocessor determines whether the front panel temperature/enter/page key has been pressed at step 382. If the answer at step 382 is negative, the control goes to step 374. If the answer at step 382 is affirmative, the master microprocessor determines whether the front panel menu key has been pressed at step 384. If the answer at step 384 is negative, the control goes to step 374. If the answer at step 384 is affirmative, the master microprocessor determines whether the front panel right timer key has been pressed at step 386. If the answer at step 386 is negative, the control goes to step 374. If the answer at step 386 is affirmative, the master microprocessor determines whether the rear panel left timer key has been pressed at step 387. If the answer at step 387 is negative, the control goes to step 374. If the answer at step 387 is affirmative, the master microprocessor determines whether the rear panel center timer key has been pressed at step 388. If the answer at step 388 is negative, control goes to step 374. If the answer at step 388 is affirmative, the master microprocessor determines whether the rear panel right timer key has been pressed at step 389.

If the answer at step 389 is negative, the master microprocessor returns to step 374. If the answer at step 389 is affirmative, the master microprocessor tests the left display for one second at step 400. At step 402 the master microprocessor determines whether the front panel temperature/enter/page key has been pressed. If the answer at step 402 is affirmative, the control goes to step 370. If the answer at step 402 is negative, the master microprocessor tests the center display for one second at step 404. At step 406 the master microprocessor determines whether the temperature/enter/page key has been pressed. If the answer at step 406 is affirmative, the control goes to step 370. If the answer at step 406 is negative, the master microprocessor tests the right display for one second at step 408. At step 410 the master microprocessor determines whether the temperature/enter/page key has been pressed. If the answer at step 410 is affirmative, the control goes to step 370. If the answer at step 410 is negative, the master microprocessor goes to step 400.

Figure 13A:
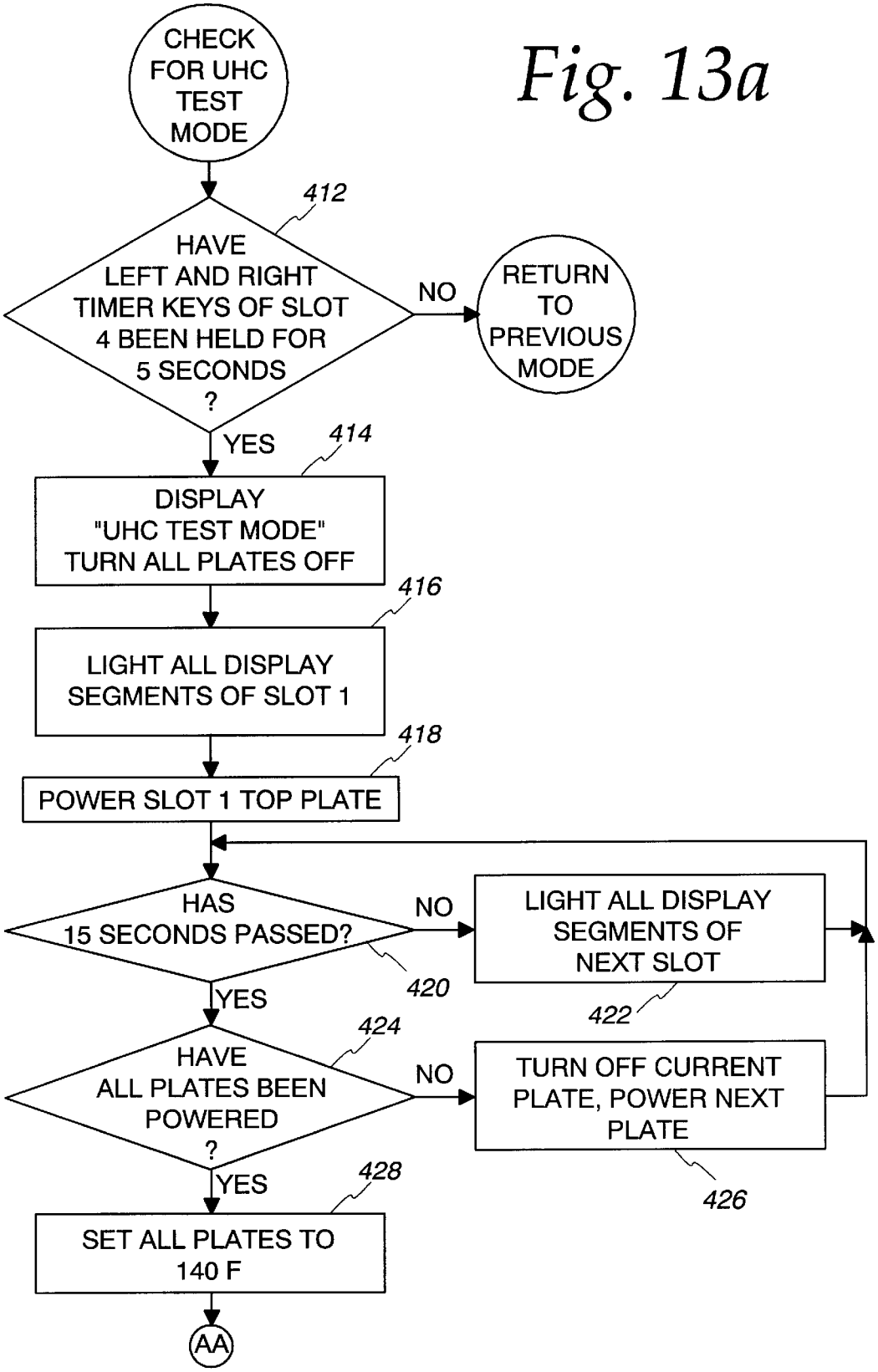
FIGS. 13*a* and 13*b* are a flow chart of the of the check for UHC test mode routine used by the control system.
Figure 13B:
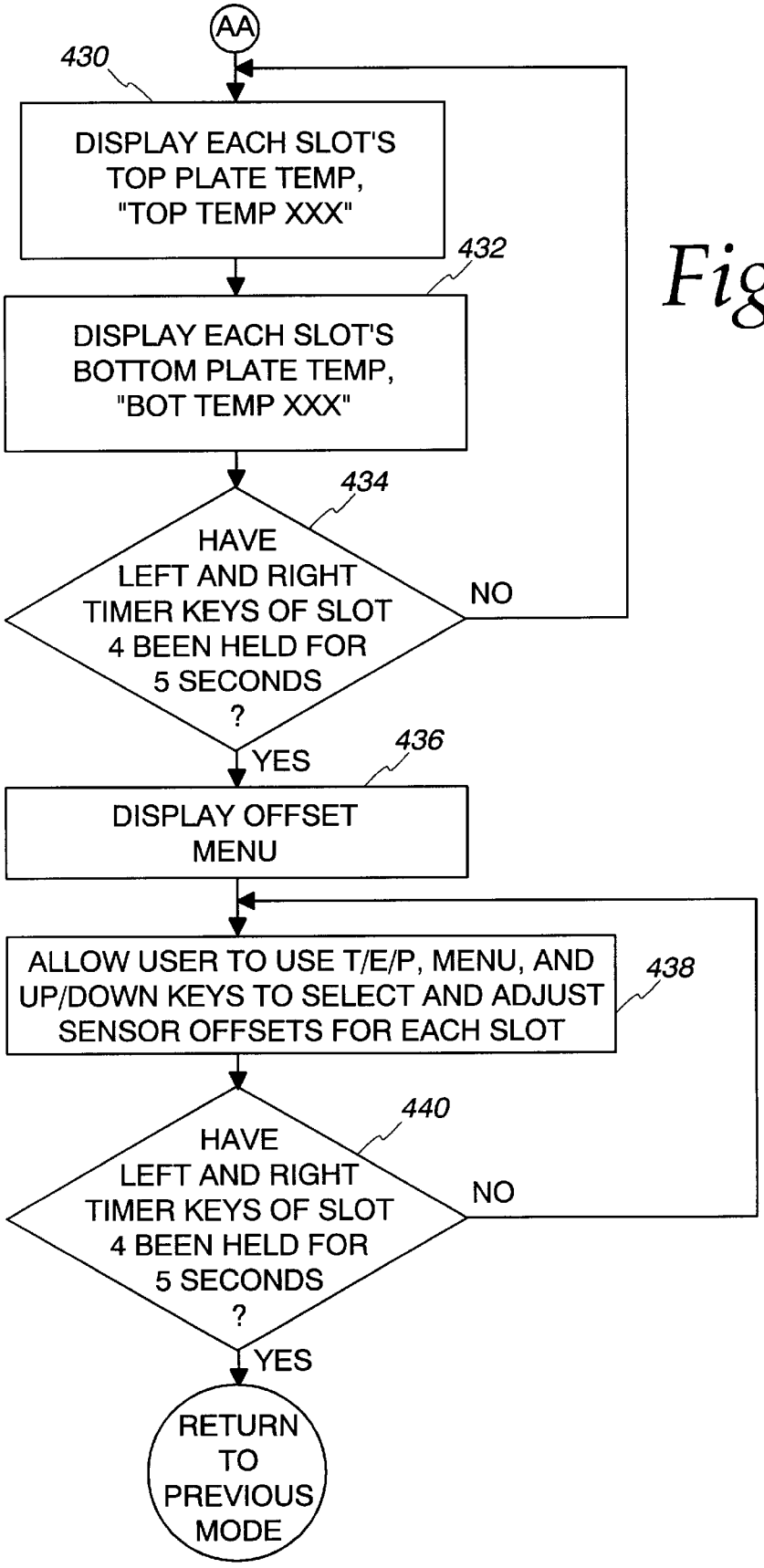

FIGS. 13*a* and 13*b* are a flow chart of the check for UHC test mode routine. In the check for UHC test mode, the master microprocessor determines whether the operator has entered the ULC test mode, and if so, tests the heater plates and allows the operator to edit the RTD sensor calibration offsets. At step 412, the master microprocessor determines whether the operator has pressed and held down the left timer key and the right timer key of passageway 4 for five seconds. If the answer at step 412 is negative, the master microprocessor returns to the previous mode. If the answer at step 412 is affirmative, the master microprocessor illustrates "UHC TEST MODE" on the lighted displays and removes AC power from the heater plates of all passageways at step 414.

At step 416, the master microprocessor lights all display segments on the front and rear display panels for passageway 1 for two seconds. At step 418, the master microprocessor supplies power to the top heater plate of passageway 1. At step 420, the master microprocessor determines whether fifteen seconds have passed. If the answer at step 420 is negative, the master microprocessor lights all display segments on the front and rear display panels for the next passageway for two seconds at step 422 before returning to step 420. If the answer at step 420 is affirmative, the master microprocessor determines whether the heater plates of all passageways have been powered at step 424. If the answer at step 424 is negative, the master microprocessor removes power from the currently powered heater plate and supplies power to the next heater plate at step 426 before returning to step 420.

If the answer at step 424 is affirmative, the master microprocessor sets the heater plates of all passageways to 140° F. at step 428. At step 430, the master microprocessor illustrates each passageways top heater plate temperature on that passageway's lighted displays, for example "TOP TEMP XX". At step 432, the master microprocessor illustrates each passageways bottom heater plate temperature on that passageway's lighted displays, for example "BOT TEMP XX". At step 434, the master microprocessor, the master microprocessor determines whether the operator has pressed and held down the left timer key and the right timer key of passageway 4 for five seconds. If the answer at step 434 is negative, the master microprocessor returns to step 430. If the answer at step 434 is affirmative, the master microprocessor displays passageway 1's top plate offset value at step 436. At step 438, the master microprocessor allows the operator to use the temperature/enter/page key, the menu key and the up/down arrow keys to select and adjust the sensor offsets for each passageway. At step 440, the master microprocessor determines whether the operator has pressed and held down the left timer key and the right timer key of passsageway 4 for five seconds. If the answer at step 440 is negative, the master microprocessor returns to step 438. If the answer at step 440 is affirmative, the master microprocessor returns to the previous mode.

The above description and several embodiments disclosed herein are made by way of example and not for purposes of limitation. Many variations may be made to the embodiments disclosed without departing from the scope and spirit of the present invention.

What is claimed is:

1. A cabinet for maintaining containers of food within a predetermined temperature range for a period of time not exceeding a predetermined maximum time, comprising:

a housing having a front panel and a passageway opening at said front panel, said passageway capable of receiving at least two containers of food;

a temperature element positioned in said passageway for maintaining said passageway within said predetermined temperature range;

a processing circuit for tracking the amount of time each container of food remains within said passageway and for providing a signal output indicating which container of food has been within said passageway the longest, and for providing an alarm signal when either container of food remains within said passageway beyond said predetermined maximum time; and a display positioned on said housing proximate to said passageway for receiving said signal output and indicating which container of food has been within said passageway the longest, and for receiving said alarm signal and indicating which container of food has been within said passageway for a period of time exceeding said predetermined maximum time.

2. The cabinet of claim 1 wherein said processing circuit further provides a time signal for each container of food indicating the amount of time remaining before said predetermined maximum time is exceeded, said display receives said time signal for each container of food and indicates the amount of time remaining before said predetermined maximum time is exceeded.

3. The cabinet of claim 1 wherein said display has at least two display intensity levels, said display indicates which container of food has been within said passageway the longest by associating the highest display intensity level with that container of food.

4. The cabinet of claim 1 further comprising a means for providing a start signal indicating that a container of food has been placed within said passageway, said processing circuit receives said start signal and tracks the amount of time the container of food remains within said passageway.

5. The cabinet of claim 4 wherein said means for providing the start signal is an operator interface positioned on said housing proximate to said passageway.

6. The cabinet of claim 1 further comprising a means for providing a stop signal indicating that a container of food has been removed from said passageway, said processing circuit receives said stop signal and stops tracking the amount of time the container of food remains within said passageway.

7. The cabinet of claim 6 wherein said means for providing the stop signal is an operator interface.

8. The cabinet of claim 1 wherein said processing circuit provides product category signals indicating a product category for each container of food, said display receives said product category signals and indicates the product category for each container of food.

9. The cabinet of claim 8 further including an operator interface positioned on said housing proximate to said passageway for providing a change product category signal indicating a new product category for a container of food, a memory holding a predetermined temperature range and a predetermined maximum time for each product category, said memory upon receiving said change product category signal provides a signal representing said new product category, said processing circuit receives said change product category signal and said representing signal from said memory to set a new predetermined temperature range and a new predetermined maximum time corresponding to said new product category for the container of food.

10. A cabinet for maintaining containers of a first food and containers of a second food within a first and second predetermined temperature range respectively for a period of time not exceeding a predetermined first and second maximum time respectively, comprising:

a housing having a front panel, a first passageway and second passageway both opening at said front panel, said first passageway capable of receiving at least two containers of the first food and said second passageway capable of receiving at least two containers of the second food;

a temperature element in each of said passageways for maintaining said first passageway within said first predetermined temperature range and said second passageway within said second predetermined temperature range;

means for identifying the presence of said containers of food within said passageways;

a processing circuit for tracking the amount of time each container of food remains within its respective passageway and for providing output signals indicating which container of food in each of said passageways has been in its respective passageway the longest and for providing an alarm signal when any container of food remains in its respective passageway beyond its respective predetermined maximum time; and a display positioned on said housing proximate to said passageways for receiving said output signals and for indicating which container of food in each of said passageways has been in its respective passageway the longest, and for receiving said alarm signal and for indicating which container of food has been within its respective passageway for a period of time exceeding its respective predetermined maximum time.

11. The cabinet of claim 10 wherein said first predetermined maximum time equals said second predetermined maximum time.

12. The cabinet of claim 11 wherein said first predetermined temperature range equals said second predetermined temperature range.

13. The cabinet of claim 10 wherein said first predetermined temperature range equals said second predetermined temperature range.

14. The cabinet of claim 10 wherein said processing circuit provides a time signal for each container of food indicating an amount of time remaining before its respective predetermined maximum time is exceeded, said display receives said time signal for each container of food and indicates the amount of time remaining before the respective predetermined maximum time for each container of food is exceeded.

15. The cabinet of claim 10 wherein said display has at least two display intensity levels, said display indicates which container of food in each of said passageways has been in its respective passageway the longest by associating the highest display intensity level with that container of food.

16. The cabinet of claim 10 wherein said identifying means comprises an operator interface positioned on said housing proximate to said passageway, said operator interface providing a start signal indicating that a container of food has been placed within one of said passageways, said processing circuit receives said start signal and tracks the amount of time the container of food remains within its respective passageway.

17. The cabinet of claim 10 wherein said identifying means comprises a sensor positioned within said passageway providing a start signal indicating that a container of food has been placed within one of said passageways, said processing circuit receives said start signal and tracks the amount of time the container of food remains within its respective passageway.

18. The cabinet of claim 10 wherein said identifying means comprises an operator interface positioned on said housing proximate to said passageway, said operator interface providing a stop signal indicating that a container of food has been removed from one of said passageways, said processing circuit receives said stop signal and stops tracking the amount of time the container of food remains within its respective passageway.

19. The cabinet of claim 10 wherein said identifying means comprises a sensor positioned within said passageway providing a stop signal indicating that a container of food has been removed from one of said passageways, said processing circuit receives said stop signal and stops tracking the amount of time the container of food remains within its respective passageway.

20. The cabinet of claim 10 wherein said processing circuit further provides a first product category signal indicating a first product category and a second product category signal indicating a second product category, said display receives said first product category signal and said second product category signal and indicates said first product category and said second product category.

21. The cabinet of claim 10 wherein said display comprises a first display positioned on said housing proximate to said first passageway for receiving said first output signal and for indicating which container has been in said first passageway the longest and for receiving said first alarm signal and for indicating which container has been in said first passageway for a period of time exceeding said first predetermined maximum time, and a second display positioned on said housing proximate to said second passageway for receiving said second output signal and for indicating which container has been in said second passageway the longest and for receiving said second alarm signal and for indicating which container has been in said second passageway for a period of time exceeding said second predetermined maximum time.

22. The cabinet of claim 21 wherein said first display comprises a first address means for uniquely identifying said first display and allowing only the reception of signals intended for said first display and said second display comprises a second address means for uniquely identifying said second display and allowing only the reception of signals intended for said second display.

23. The cabinet of claim 22 wherein said first addressing means comprises a first and second address line, said first address line receiving an address signal corresponding to said first passageway, and said second address means comprises a first and second address line, said second address line receiving said address signal corresponding to said second passageway.

24. A control system for maintaining within a predetermined temperature range for a period of time not exceeding a predetermined maximum time at least two containers of food within a cabinet having a passageway capable of holding the containers of food, a heating device and a temperature sensor positioned in the passageway and a display mounted on the cabinet proximate to the passageway, said control system comprising:

a temperature circuit for controlling the heating device and maintaining the passageway within the predetermined temperature range; and a processing circuit for tracking the amount of time each container of food remains within the passageway and for providing a signal output to the display indicating which container of food has been within the passageway the longest, and for providing an alarm signal to the display when any container of food remains within the passageway beyond the predetermined maximum time.

25. The control system of claim 24 wherein the display comprises an automatic sensor positioned in the passageway to detect a container of food placed in the passageway.

26. The control system of claim 24 wherein said processing circuit further provides to the display a time signal for each container of food indicating the amount of time remaining before the predetermined maximum time is exceeded.

27. The control system of claim 25 wherein said processing circuit receives a start signal from the display indicating that a container of food has been placed within the passageway, said processing circuit upon receiving said start signal tracks the amount of time the container of food remains within the passageway.

28. The control system of claim 25 wherein said processing circuit further receives a stop signal from the display indicating a container of food has been removed from the passageway, said processing circuit upon receiving said stop signal stops tracking the amount of time the container of food remains within the passageway.

29. The control system of claim 24 wherein said processing circuit further provides a product category signal to the display indicating a product category for each container of food.

30. The control system of claim 29 further comprising a memory for holding a predetermined temperature range and a predetermined maximum time for each product category, said memory receives a change category signal from the display indicating a new product category for a container of food, said memory upon receiving said change product category signal provides a signal representing said new category, said processing circuit receives said change product category signal and said representing signal from said memory to set a new predetermined temperature range and a new predetermined maximum time corresponding to said new product category for the container of food.

31. The control system of claim 24 wherein said temperature circuit is capable of receiving a temperature signal from the temperature sensor, said temperature signal indicating the passageway is not within the predetermined temperature range, said temperature circuit upon receiving said temperature signal sends a heat signal to the heating device to maintain the passageway within the predetermined temperature range.

32. A control system for use in a cabinet having a housing with a front panel, a first and second passageway opening at the front panel, a first heating device and first temperature sensor positioned in the first passageway, a second heating device and a second temperature sensor positioned in the second passageway, a first display positioned on the front panel proximate the first passageway and a second display positioned on the front panel proximate the second passageway, said control system maintaining at least two containers of a first food product within the first passageway within a first predetermined temperature range for a period of time not exceeding a first predetermined maximum time and at least two containers of a second food product within the second passageway within a second predetermined temperature range for a period of time not exceeding a second predetermined maximum time, said control system comprising:

a temperature circuit for controlling the first heating device and the second heating device and maintaining the first passageway within the first predetermined temperature range and maintaining the second passageway within the second predetermined temperature range;

a processing circuit for tracking the amount of time each container of food remains within its respective passageway and for providing output signals to the first display and the second display indicating which container of food in each of said passageways has been in the respective passageway the longest and for providing an alarm signal to the first display a second display when a container of food remains in its respective passageway beyond its respective predetermined maximum time.

33. The control system of claim 32 wherein said first predetermined maximum time equals said second predetermined maximum time.

34. The control system of claim 33 wherein said first predetermined temperature range equals said second predetermined temperature range.

35. The control system of claim 32 wherein said first predetermined temperature range equals said second predetermined temperature range.

36. The control system of claim 32 wherein said processing circuit further provides a first time signal to the first display for each container of the first food product indicating the amount of time remaining before the first predetermined maximum time is exceeded, and a second time signal to the second display for each container of the second food product indicating the amount of time remaining before the second predetermined maximum time is exceeded.

37. The control system of claim 32, wherein the first display includes a first automatic sensor positioned in the first passageway to detect a container of first food product placed in the first passageway, the second display includes a second automatic sensor positioned in the second passageway to detect a container of the second said food product place in the second passageway.

38. The control system of claim 37 wherein said processing circuit capable of receiving a first start signal from the first display indicating that a container of the first food product has been placed within the first passageway and a second start signal from the second display indicating that a container of the second food product has been placed within the second passageway, said processing circuit upon receiving said first start signal tracks the amount of time the container of the first food product remains within the first passageway, said processing circuit upon receiving said second start signal tracks the amount of time the container of the second food product remains within the second passageway.

39. The control system of claim 37 wherein said processing circuit is capable of receiving a first stop signal from the first display indicating that a container of the first food product has been removed from the first passageway and a second stop signal from the second display indicating that a container of the second food product has been removed from the second passageway, said processing circuit upon receiving said first stop signal stops tracking the amount of time the container of the first food product remains within the first passageway, said processing circuit upon receiving said second stop signal stops tracking the amount of time the container of the second food product remains within the second passageway.

40. The control system of claim 32 wherein said processing circuit further provides a first product category signal to the first display indicating a product category for each container of first food product and a second product category signal to the second display indicating the product category for each container of second food product.

41. The control system of claim 40 further comprising a memory for holding a predetermined temperature range and a predetermined maximum time for each product category, said memory capable of receiving a first change category signal from the first display indicating a new first product category for the container of the first food product, said memory upon receiving said first change category signal provides a first signal representing said new first product category, said processing circuit capable of receiving said first representing signal and said first change product category signal from said memory to set a new first predetermined temperature range and a new first predetermined maximum time corresponding to said new first product category for the container of the first food product, said memory is further capable of receiving a second change category signal from the second display indicating a new second product category for the container of the second food product, said memory upon receiving said second change category signal provides a second signal representing said new second product category, said processing circuit capable of receiving said second representing signal and said second change product category signal from said memory to set a new second predetermined temperature range and a new second predetermined maximum time corresponding to said new second product category for the container of the second food product.

42. The control system of claim 32 wherein said temperature circuit is capable of receiving a first temperature signal from the first temperature sensor and the second temperature signal from the second temperature sensor, said first temperature signal indicating the first passageway is not within said first predetermined temperature range, said temperature circuit upon receiving said first temperature signal sends a first heat signal to the first heating device to maintain the first passageway within the first predetermined temperature range, said second temperature signal indicating the second passageway is not within said second predetermined temperature range, said temperature circuit upon receiving said second temperature signal sends a second heat signal to the second heating device to maintain the second passageway within the second predetermined temperature range.

43. The control system of claim 32 further comprises a first address means for uniquely identifying the first display and allowing only the signals intended for the first display to be transmitted to the first display and a second address means for uniquely identifying the second display and allowing only the signals intended for the second display to be transmitted to the second display.

44. A method for maintaining within a predetermined temperature range for a period of time not exceeding a predetermined maximum time at least two containers of food within a cabinet having a passageway capable of holding the containers of food, a heating device mounted in the passageway and a display mounted on the cabinet proximate to the passageway, said method comprising the steps:

maintaining the passageway within the predetermined temperature range;

tracking the amount of time each container of food remains within the passageway;

indicating on the display which container of food has been within the passageway the longest; and indicating on the display when a container of food remains within the passageway beyond the predetermined maximum time.

45. The method of claim 44 further comprising the step of indicating on the display the amount of time remaining before the predetermined maximum time is exceeded for each container.

46. The method of claim 44 further comprising the step of determining when a container of food is placed within the passageway and then starting to track the amount of time the container of food remains within the passageway.

47. The method of claim 44 further comprising the steps of determining when a container of food is removed from the passageway and then stopping to track the amount of time the container of food remains within the passageway.

48. The method of claim 44 further comprising the step of indicating on the display a product category for each container of food.

49. A method for maintaining at least two containers of a first food product within a first passageway of a cabinet within a first predetermined temperature range for a period of time not exceeding a first predetermined maximum time and at least two containers of a second food product within a second passageway of the cabinet within a second predetermined temperature range for a period of time not exceeding a second predetermined maximum time, said cabinet having a housing with a front panel, said first and second passageway opening at the front panel, a first heating device positioned in the first passageway, a second heating device positioned in the second passageway, a first display positioned on the front panel proximate the first passageway and a second display positioned on the front panel proximate the second passageway, said method comprising the steps:

maintaining the first passageway within the first predetermined temperature range and maintaining the second passageway within the second predetermined temperature range;

tracking the amount of time each container of food remains within its respective passageway;

indicating which container of food in each of said passageways has been in its respective passageway the longest; and indicating when a container of food remains in its respective passageway beyond its respective predetermined maximum time.

50. The cabinet of claim 49 wherein said first predetermined maximum time equals said second predetermined maximum time.

51. The cabinet of claim 49 wherein said first predetermined temperature range equals said second predetermined temperature range.

52. The cabinet of claim 49 wherein said first predetermined temperature range equals said second predetermined temperature range.

53. The method of claim 49 further comprising the step of indicting on the first display and the second display the amount of time remaining before its respective predetermined maximum time is exceeded for each container of food.

54. The method of claim 49 further comprising the step of determining when a container of the first food product is placed within the first passageway and then tracking the amount of time the container of the first food product remains within the first passageway and determining when a container of the second food product is placed within the second passageway and then tracking the amount of time the container of the second food product remains within the second passageway.

55. The method of claim 49 further comprising the step of determining when a container of the first food product is removed from the first passageway and then ceasing to track the amount of time the container of the first food product remains within the first passageway and determining when a container of the second food product is removed from the second passageway and then ceasing to track the amount of time the container of the second food product remains within the second passageway.

56. The method of claim 49 further comprising the steps of indicating on the first display a first product category for each container of the first food product and indicating on the second display a second product category for each container of the second food.

57. The method of claim 49 further comprising the steps of allowing only the signals intended for the first display to be transmitted to the first display and allowing only signals intended for the second display to be transmitted to the second display.

* * * * *

UNITED STATES PATENT AND TRADEMARK OFFICE

CERTIFICATE OF CORRECTION

PATENT NO. : 6,011,243

DATED : January 4, 2000

INVENTOR(S) : Anthony W. Arnold, Steven B. Collins, Jack M. Johnson, Jeffrey S. Williams, John M. Cox, John Guthrie and Thomas A. McMillan It is certified that error appears in the above-identified patent and that said Letters Patent is hereby corrected as shown below:

On the title page under [73] Assignee, please add the Assignee - Emerson Electric Co. - therefor.

Signed and Sealed this

Fourteenth Day of November, 2000

*Attest:*

Q. TODD DICKINSON

*Attesting Officer*

*Director of Patents and Trademarks*